US012753921B1

(12) United States Patent
Salazar Lois et al.

(10) Patent No.: US 12,753,921 B1
(45) Date of Patent: Oct. 6, 2026

(54) COMBUSTOR ASSEMBLY FOR A GAS TURBINE ENGINE

(71) Applicant: General Electric Company, Evendale, OH (US)

(72) Inventors: Gerardo Antonio Salazar Lois, West Chester, OH (US); Steven Marakovits, Mason, OH (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 19/260,933

(22) Filed: Jul. 7, 2025

(51) Int. Cl.
*F23R 3/00* (2006.01)
*F23R 3/60* (2006.01)

(52) U.S. Cl.
CPC ..... *F23R 3/002* (2013.01); *F23R 3/007* (2013.01); *F23R 3/60* (2013.01); *F23R 2900/03044* (2013.01)

(58) Field of Classification Search
CPC ..... F23R 3/002
See application file for complete search history.

(56) References Cited

U.S. PATENT DOCUMENTS 8,833,084 B2 9/2014 Carlisle
9,651,258 B2 5/2017 Graves et al.
10,767,863 B2 9/2020 Freeman et al.
10,907,830 B2 2/2021 Wilson et al.
11,466,855 B2 10/2022 Freeman et al.
12,066,187 B2 * 8/2024 Ganiger ..... F23R 3/60
2002/0056277 A1 5/2002 Parry
2016/0109129 A1 4/2016 Rettig
2017/0205069 A1 7/2017 Trentorio et al.
2018/0202659 A1 * 7/2018 Stieg ..... F23R 3/002
2020/0025378 A1 1/2020 Petty, Sr. et al.
2021/0372616 A1 * 12/2021 Cheung ..... F23R 3/08
2023/0296251 A1 9/2023 Sampath et al.
2023/0366545 A1 * 11/2023 Ganiger ..... F23R 3/60
2023/0366554 A1 * 11/2023 Ganiger ..... F23R 3/002
2025/0067434 A1 2/2025 Dutka

* cited by examiner

*Primary Examiner* — Lorne E Meade
*Assistant Examiner* — Alyson Joan Harrington
(74) *Attorney, Agent, or Firm* — Dority & Manning, P.A.

(57) ABSTRACT

A gas turbine engine generally defines an axial direction and includes a combustor assembly. The combustor assembly includes a plurality of liner tiles defining at least part of a combustion chamber that extends between a forward end and an aft end generally along the axial direction. A combustor liner support assembly is positioned on a cold side of the plurality of liner tiles and defines a rail extending radially toward the combustion chamber. A retainer assembly includes a bushing where at least one liner tile of the plurality of liner tiles is floatably coupled to the rail via the bushing.

19 Claims, 9 Drawing Sheets

COMBUSTOR ASSEMBLY FOR A GAS TURBINE ENGINE

FIELD

The present subject matter relates generally to a gas turbine engine, or more particularly to a combustor assembly for a gas turbine engine.

BACKGROUND

A gas turbine engine generally includes a fan and a core arranged in flow communication with one another. In addition, the core of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gasses through the turbine section drives the turbine section and is then routed through the exhaust section, e.g., to the atmosphere.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

Figure 1:
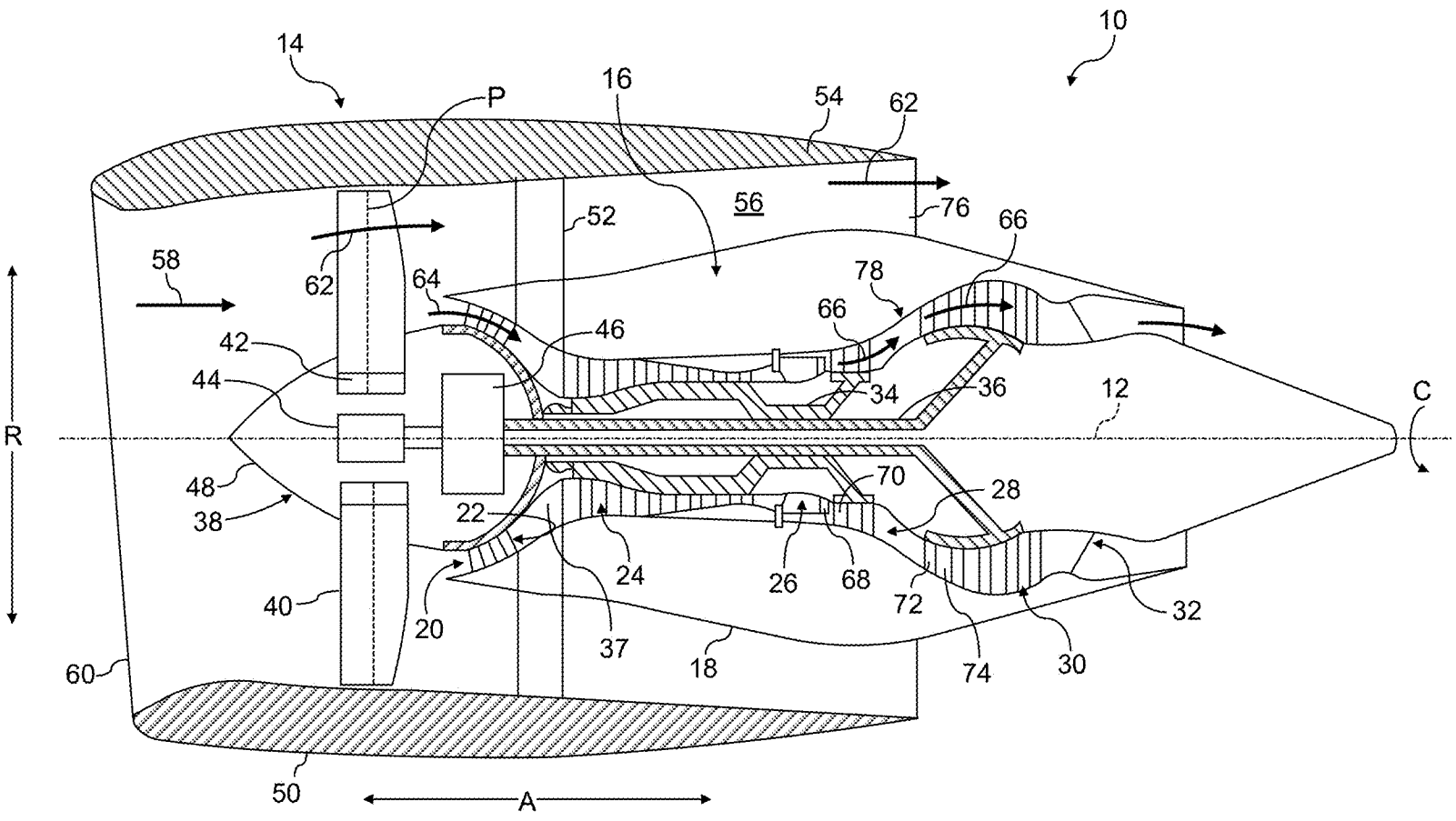
FIG. 1 is a schematic view of an exemplary gas turbine engine in accordance with one or more embodiments of the present disclosure.

Repeat use of reference characters in the present specification and drawings is intended to represent the same or analogous features or elements of the present disclosure.

DETAILED DESCRIPTION

Reference now will be made in detail to embodiments of the present disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the present disclosure. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The singular forms "a", "an", and "the" include plural references unless the context clearly dictates otherwise.

The term "at least one of" in the context of, e.g., "at least one of A, B, or C" refers to only A, only B, only C, or any combination of A, B, and C.

The terms "coupled," "fixed," "attached to," and the like refer to both direct coupling, fixing, or attaching, as well as indirect coupling, fixing, or attaching through one or more intermediate components or features, unless otherwise specified herein.

As used herein, the terms "first," "second," and "third" may be used interchangeably to distinguish one component from another and are not intended to signify location or importance of the individual components.

For purposes of the description hereinafter, the terms "upper", "lower", "right", "left", "vertical", "horizontal", "top", "bottom", "lateral", "longitudinal", and derivatives thereof shall relate to the embodiments as they are oriented in the drawing figures. However, it is to be understood that the embodiments may assume various alternative variations, except where expressly specified to the contrary. It is also to be understood that the specific devices illustrated in the attached drawings, and described in the following specification, are simply exemplary embodiments of the disclosure. Hence, specific dimensions and other physical characteristics related to the embodiments disclosed herein are not to be considered as limiting.

The term "adjacent" as used herein with reference to two walls and/or surfaces refers to the two walls and/or surfaces contacting one another, or the two walls and/or surfaces being separated only by one or more nonstructural layers and the two walls and/or surfaces and the one or more nonstructural layers being in a serial contact relationship (i.e., a first wall/surface contacting the one or more nonstructural layers, and the one or more nonstructural layers contacting a second wall/surface.

The term "proximate" refers to being closer to one end than an opposite end. For example, when used in conjunction with first and second ends; high pressure and low pressure sides; or the like, the phrase "proximate the first end," or "proximate the high pressure side," refers to a location closer to the first end than the second end, or closer to the high pressure side than the low pressure side, respectively.

The terms "upstream" and "downstream" refer to the relative direction with respect to fluid flow in a fluid pathway. For example, "upstream" refers to the direction from which the fluid flows, and "downstream" refers to the direction to which the fluid flows. Terms of approximation, such as "about" or "approximately," refer to being within a ten percent margin of error.

The term "turbomachine" refers to a machine including one or more compressors, a heat generating section (e.g., a combustion section), and one or more turbines that together generate a torque output.

The term "gas turbine engine" refers to an engine having a turbomachine as all or a portion of its power source. Example gas turbine engines include turbofan engines, turboprop engines, turbojet engines, turboshaft engines, etc., as well as hybrid-electric versions of one or more of these engines.

The term "combustion section" refers to any heat addition system for a turbomachine. For example, the term combustion section may refer to a section including one or more of a deflagrative combustion assembly, a rotating detonation combustion assembly, a pulse detonation combustion assembly, or other appropriate heat addition assembly. In certain example embodiments, the combustion section may include an annular combustor, a can combustor, a cannular combustor, a trapped vortex combustor (TVC), or other appropriate combustion system, or combinations thereof.

The terms "low" and "high", or their respective comparative degrees (e.g., -er, where applicable), when used with a compressor, a turbine, a shaft, or spool components, etc. each refer to relative speeds within an engine unless otherwise specified. For example, a "low turbine" or "low speed turbine" defines a component configured to operate at a rotational speed, such as a maximum allowable rotational speed, lower than a "high turbine" or "high speed turbine" of the engine.

The terms "forward" and "aft" refer to relative positions within a gas turbine engine or vehicle, and are based on a normal operational attitude of the gas turbine engine or vehicle. More particularly, forward and aft are used herein with reference to a direction of travel of the vehicle and a direction of propulsive thrust of the gas turbine engine.

As used herein, the terms "axial" and "axially" refer to directions and orientations that extend substantially parallel to a centerline of the gas turbine engine. Moreover, the terms "radial" and "radially" refer to directions and orientations that extend substantially perpendicular to the centerline of the gas turbine engine. In addition, as used herein, the terms "circumferential" and "circumferentially" refer to directions and orientations that extend arcuately about the centerline of the gas turbine engine.

As used herein, "floatably coupled" means that two elements are coupled to each other but may also move within a limited range relative to each other.

A combustor liner of a combustor of a gas turbine engine is typically supported by a support structure. During operation, combustors typically experience variations in temperature. Thus, combustor materials expand when heated, and variations in temperature result in different amounts of thermal expansion or contraction of different portions of the combustor liner. Also, the support structure may have a coefficient of thermal expansion or contraction that is different from the coefficient of thermal expansion or contraction of the combustor liner material. Accordingly, thermal stress may be induced in the combustor liner due to differential expansion within the combustor liner itself and with respect to the combustor liner support structure.

Embodiments of the present disclosure provide a combustor assembly for a gas turbine engine including a plurality of liner tiles defining at least a portion of a combustor liner of a combustor of a gas turbine engine. The liner tiles may be metallic or non-metallic. By way of non-limiting example, non-metallic liner tiles may be made from a ceramic material such as a ceramic matrix composite (CMC) material. Embodiments of the present disclosure floatably couple the liner tiles to a combustor liner support assembly to enable thermal expansion of the liner tiles in one or more of an axial direction, a radial direction, or a circumferential direction. Further, a retainer assembly according to exemplary embodiments of the present disclosure used to floatably couple the liner tiles to the combustor liner support assembly is substantially shielded from the hot gases within the combustion chamber. The combustor liner support assembly is also configured provide cooling to the liner tiles. In exemplary embodiments, the combustor liner support assembly includes a number of combustor liner support apertures to enable a cooling fluid supply to impinge directly on the liner tiles. Additionally, embodiments of the present disclosure provide a number of spline seals located with respect to the liner tiles that vary an amount of cooling fluid flow to the liner tiles in response to varying expansion and contraction of the liner tiles due to thermal conditions in the combustor.

Referring now to the drawings, wherein identical numerals indicate the same elements throughout the Figures, FIG. 1 is a schematic cross-sectional view of a gas turbine engine 10 in accordance with an exemplary embodiment of the present disclosure. More particularly, for the embodiment of FIG. 1, the gas turbine engine is a high-bypass turbofan jet engine, sometimes also referred to as a "turbofan engine." As shown in FIG. 1, the gas turbine engine 10 defines an axial direction A (extending parallel to a longitudinal axis 12 provided for reference), a radial direction R, and a circumferential direction C extending about the longitudinal axis 12. In general, the gas turbine engine 10 includes a fan section 14 and a turbomachine 16 disposed downstream from the fan section 14.

The exemplary turbomachine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft 34 (which may additionally or alternatively be a spool) drivingly connects the HP turbine 28 to the HP compressor 24. A low pressure (LP) shaft 36 (which may additionally or alternatively be a spool) drivingly connects the LP turbine 30 to the LP compressor 22. The compressor section, combustion section 26, turbine section, and jet exhaust nozzle section 32 together define a working gas flowpath 37.

For the embodiment depicted, the fan section 14 includes a fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable pitch change mechanism 44 configured to collectively vary the pitch of the fan blades 40, e.g., in unison. The gas turbine engine 10 further includes a power gearbox 46, and the fan blades 40, disk 42, and pitch change mechanism 44 are together rotatable about the longitudinal axis 12 by LP shaft 36 across the power gearbox 46. The power gearbox 46 includes a plurality of gears for adjusting a rotational speed of the fan 38 relative to a rotational speed of the LP shaft 36, such that the fan 38 may rotate at a more efficient fan speed.

Referring still to the exemplary embodiment of FIG. 1, the disk 42 is covered by a rotatable front hub 48 of the fan section 14 (sometimes also referred to as a "spinner"), the front hub 48 aerodynamically contoured to promote an airflow through the plurality of fan blades 40.

Additionally, the exemplary fan section 14 includes an annular fan casing or outer nacelle 50 that circumferentially surrounds the fan 38 and/or at least a portion of the turbomachine 16. It should be appreciated that the outer nacelle 50 is supported relative to the turbomachine 16 by a plurality of circumferentially-spaced outlet guide vanes 52 in the embodiment depicted. Moreover, a downstream section 54 of the outer nacelle 50 extends over an outer portion of the turbomachine 16 so as to define a bypass airflow passage 56 therebetween.

During operation of the gas turbine engine 10, a volume of air 58 enters the gas turbine engine 10 through an associated inlet 60 of the outer nacelle 50 and fan section 14. As the volume of air 58 passes across the fan blades 40, a first portion of air 62 is directed or routed into the bypass airflow passage 56 and a second portion of air 64 is directed or routed into the working gas flowpath 37, or more specifically into the LP compressor 22. The ratio between the first portion of air 62 and the second portion of air 64 is commonly known as a bypass ratio. A pressure of the second portion of air 64 is then increased as it is routed through the HP compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft 34, thus causing the HP shaft 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft 36, thus causing the LP shaft 36 to rotate, thereby supporting operation of the LP compressor 22 and/or rotation of the fan 38.

The combustion gases 66 are subsequently routed through the jet exhaust nozzle section 32 of the turbomachine 16 to provide propulsive thrust.

Simultaneously, the pressure of the first portion of air 62 is substantially increased as the first portion of air 62 is routed through the bypass airflow passage 56 before it is exhausted from a fan nozzle exhaust section 76 of the gas turbine engine 10, also providing propulsive thrust. The HP turbine 28, the LP turbine 30, and the jet exhaust nozzle section 32 at least partially define a hot gas path 78 for routing the combustion gases 66 through the turbomachine 16.

It should be appreciated, however, that the exemplary gas turbine engine 10 depicted in FIG. 1 is by way of example only, and that in other exemplary embodiments, the gas turbine engine 10 may have any other suitable configuration. For example, although the gas turbine engine 10 depicted is configured as a ducted gas turbine engine (i.e., including the outer nacelle 50), in other embodiments, the gas turbine engine 10 may be an unducted gas turbine engine (such that the fan 38 is an unducted fan, and the outlet guide vanes 52 are cantilevered from the outer casing 18). Additionally, or alternatively, although the gas turbine engine 10 depicted is configured as a geared gas turbine engine (i.e., including the power gearbox 46) and a variable pitch gas turbine engine (i.e., including a fan 38 configured as a variable pitch fan), in other embodiments, the gas turbine engine 10 may additionally or alternatively be configured as a direct drive gas turbine engine (such that the LP shaft 36 rotates at the same speed as the fan 38), as a fixed pitch gas turbine engine (such that the fan 38 includes fan blades 40 that are not rotatable about a pitch axis P), or both. It should also be appreciated, that in still other exemplary embodiments, aspects of the present disclosure may be incorporated into any other suitable gas turbine engine. For example, in other exemplary embodiments, aspects of the present disclosure may (as appropriate) be incorporated into, e.g., a turboprop gas turbine engine, a turboshaft gas turbine engine, or a turbojet gas turbine engine.

Figure 2:
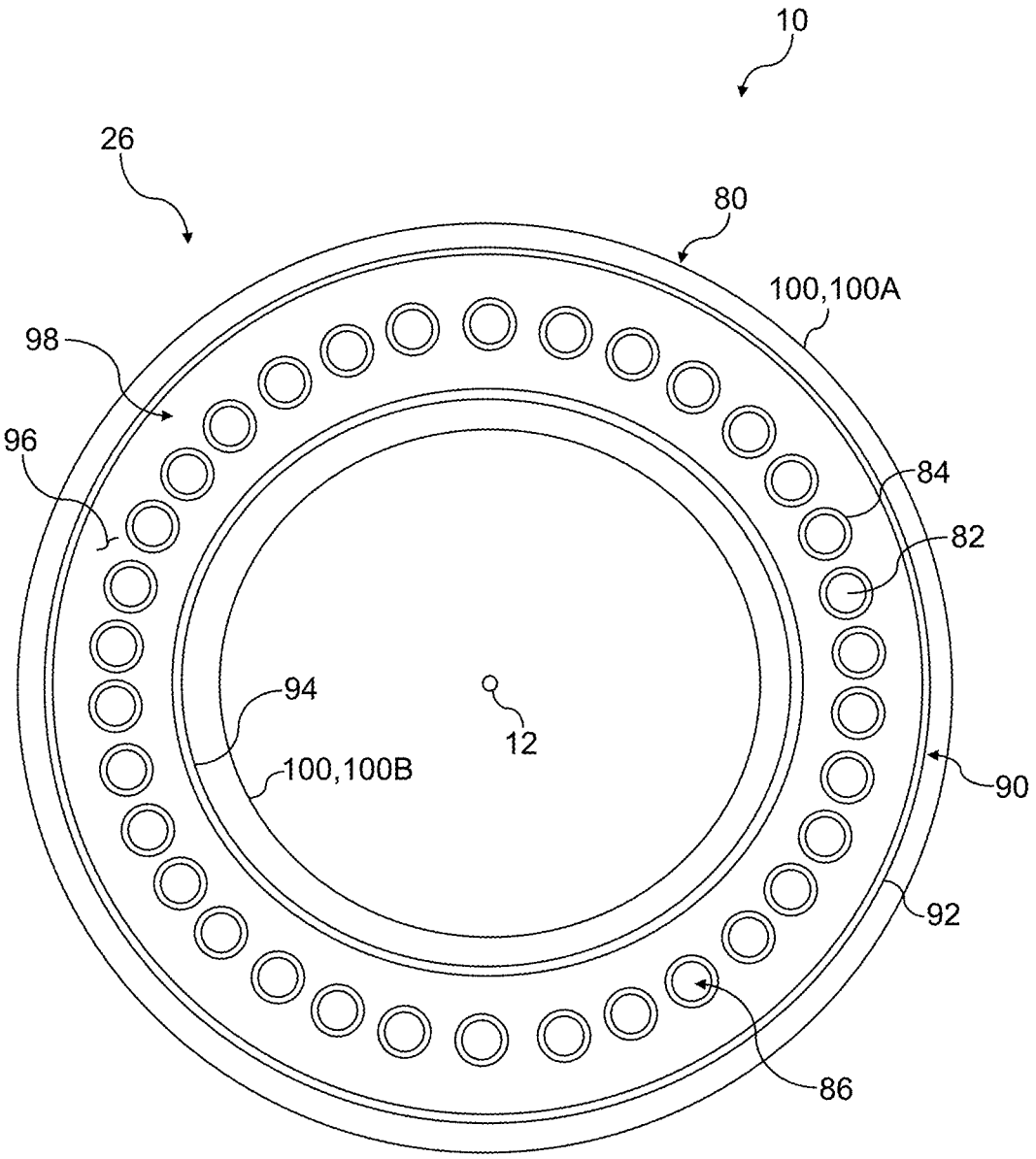
FIG. 2 is a schematic axial view of a portion of an exemplary combustion section of an exemplary gas turbine engine in accordance with one or more embodiments of the present disclosure.

FIG. 2 is a schematic diagram depicting an axial view of a portion of the combustion section 26 viewed in an axially forward direction. In the embodiment illustrated in FIG. 2, the combustion section 26 includes a combustor assembly 80. The combustor assembly 80 may include a set of fuel injectors 82 annularly arranged about the longitudinal axis 12 of the gas turbine engine 10. A combustor 84 is fluidly connected to the set of fuel injectors 82 to define at least a portion of a set of fuel cups 86 annularly provided about the longitudinal axis 12.

A combustor liner 90 including an outer combustor liner 92 and an inner combustor liner 94 concentric with respect to each other and annular about the longitudinal axis 12 defines the combustor 84. The combustor liner 90 also further defines the set of fuel cups 86. A dome wall 96 together with the combustor liner 90 can define a combustion chamber 98 of the combustor 84 annular about the longitudinal axis 12. The set of fuel cups 86 can be fluidly coupled to the combustion chamber 98.

The combustor 84 can have a can, can-annular, or annular arrangement depending on the type of engine in which the combustor 84 is located. The combustor liner 90 can also have a varying geometry. The outer combustor liner 92 and the inner combustor liner 94 may each be supported by a combustor liner support assembly 100. In the embodiment illustrated in FIG. 2, the outer combustor liner 92 is supported by a combustor liner support assembly 100A, and the inner combustor liner 94 is supported by a combustor liner support assembly 100B.

Figure 3:
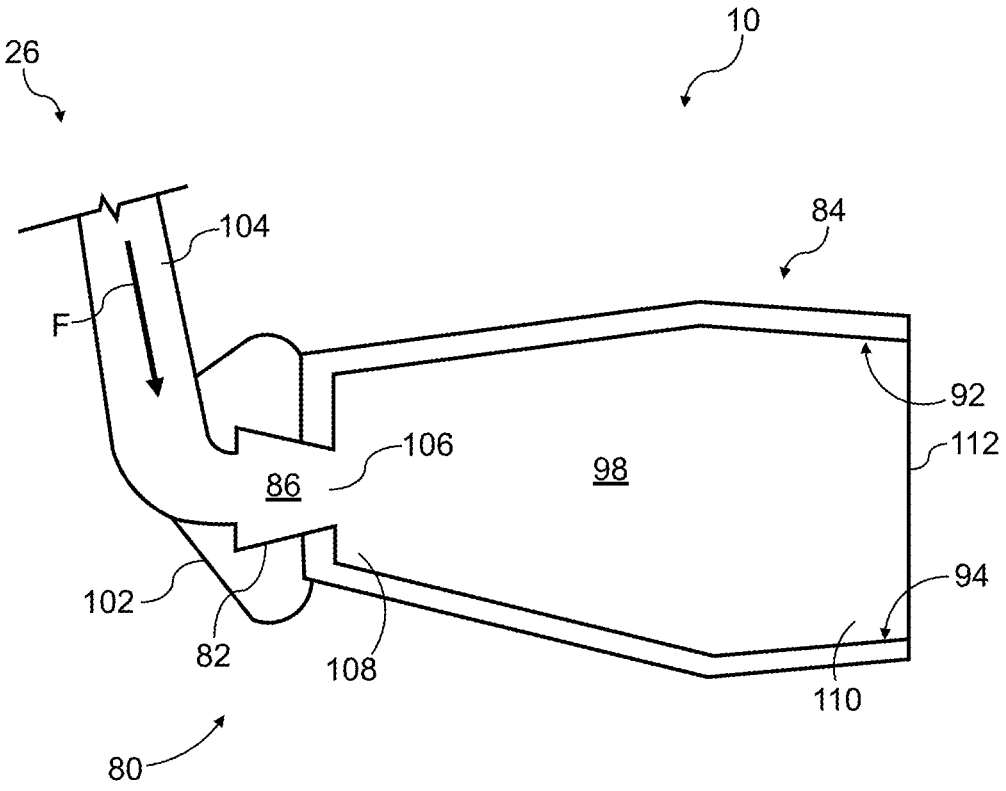
FIG. 3 is a schematic side view of a portion of an exemplary combustion section of an exemplary gas turbine engine in accordance with embodiments of the present disclosure.

FIG. 3 depicts a schematic, side view of a portion of the combustion section 26. A dome assembly 102 can house the fuel injectors 82 (only one shown in FIG. 3). The fuel injectors 82 can be fluidly coupled to a fuel passageway 104 that is configured to receive a flow of fuel (F). The fuel injectors 82 can terminate in a dome inlet 106 to define the fuel cup 86. The combustor 84 includes the combustion chamber 98 extending axially from a forward end 108 proximate to the dome inlet 106 to an aft end 110 proximate to a combustor outlet 112 and at least partially defined by the outer combustor liner 92 and the inner combustor liner 94.

Figure 4:
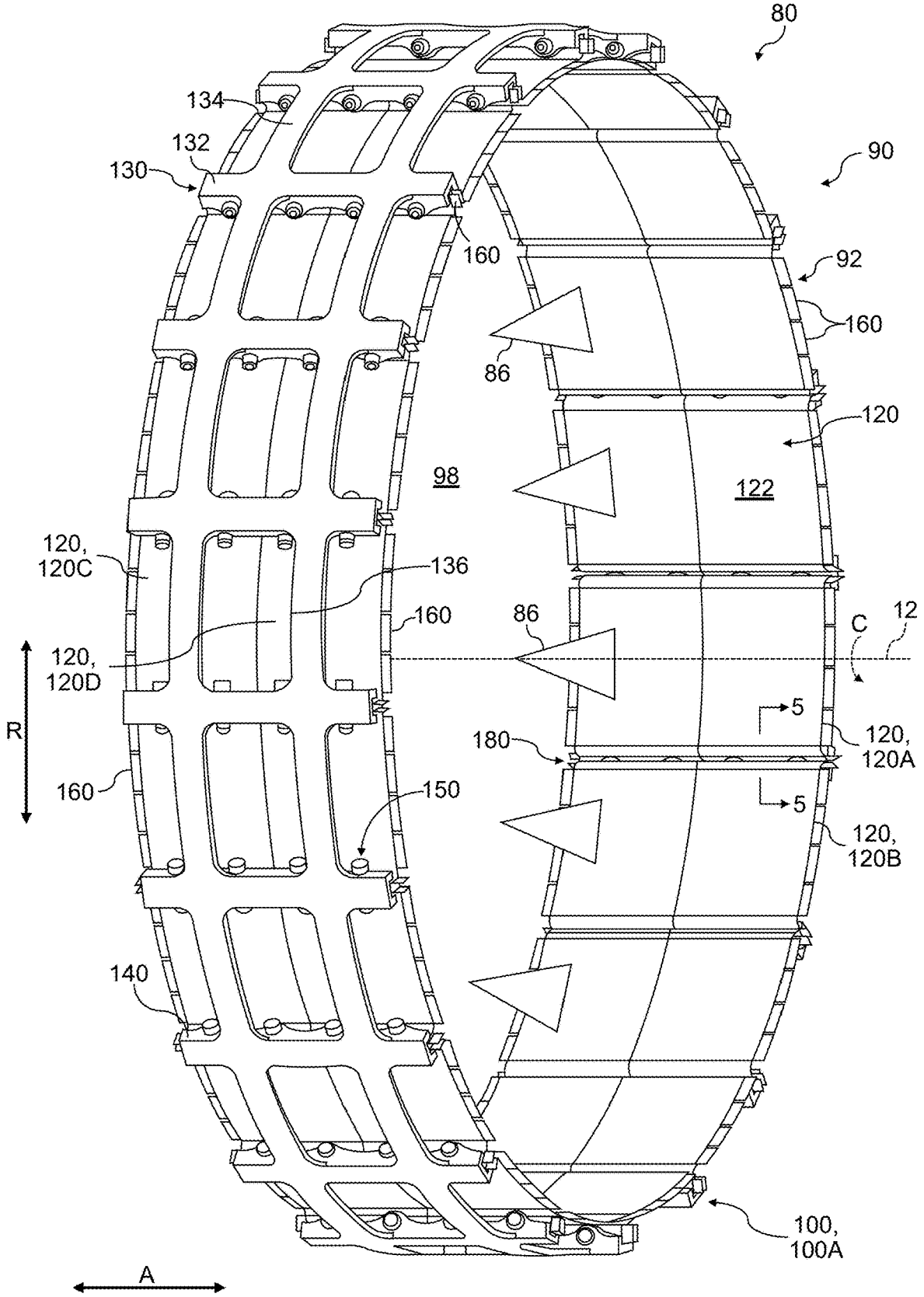
FIG. 4 is a schematic perspective view of a portion of an exemplary combustor assembly in accordance with embodiments of the present disclosure.

FIG. 4 depicts a schematic perspective view of a portion of the combustor assembly 80 in accordance with an exemplary aspect of the present disclosure. The exemplary combustor assembly 80 of FIG. 4 may be configured in substantially the same manner as the structures previously described in reference to the combustor section 26 and combustor liner 90 of the earlier figures, and accordingly, similar reference numerals refer to similar parts. In the embodiment illustrated in FIG. 4, the combustor assembly 80 includes the outer combustor liner 92 defined by a plurality of liner tiles 120 arranged to define at least a portion of the combustion chamber 98. In the embodiment depicted in FIG. 4, an axial segment of the combustor 84 (FIG. 3) is depicted. However, it should be understood that remaining axial portions of the combustor 84 may be similarly configured. However, for the embodiment of FIG. 4, the arrangement, support, and coupling of the liner tiles 120 to the combustor liner support assembly 100A, as well as the orientation of certain internal cooling and sealing features, are shown in more detail. Although FIG. 4, and the remaining FIGS. 5-10, depict and describe the combustor assembly 80 with respect to the outer combustor liner 92 and the combustor liner support assembly 100A, it should be understood that the inner combustor liner 94 and the combustor liner support assembly 100B (FIG. 3) may be similarly configured. The combustor assembly 80 may be oriented to have the radial direction R, the axial direction A, and the circumferential direction C, which may correspond to like directions as set forth in FIG. 1.

In the embodiment illustrated in FIG. 4, the combustor liner 90 includes the outer combustor liner 92 defined by one or more annular rows of liner tiles 120. In the embodiment depicted in FIG. 4, two annular rows of the liner tiles 120 are depicted with each row defining an axial segment of the outer combustor liner 92; however, it should be understood that a greater or fewer quantity of annular rows of liner tiles 120 may be used. In the embodiment depicted in FIG. 4, a particular annular row of liner tiles 120 includes a quantity of liner tiles 120 positioned adjacent each other extending in the circumferential direction C. By way of non-limiting example, FIG. 4 depicts individual liner tiles 120A and 120B positioned adjacent each in the circumferential direction C. In the axial direction A, FIG. 4 depicts individual liner tiles 120C and 120D positioned adjacent each other in the axial direction A. Thus, an axial and circumferential array of liner tiles 120 define the outer combustor liner 92. Thus, in the illustrated embodiment of FIG. 4, a particular liner tile 120 may be positioned circumferentially adjacent one or more other liner tiles 120, and the circumferential rows of liner tiles 120 are axially stacked such that the liner tiles 120 collectively form a segmented annular combustor liner surface. Each liner tile 120 defines a liner tile inner surface 122 facing the combustion chamber 98 and subjected to the hot gas environment (e.g., a hot side of the liner tile 120), and a liner tile outer surface 124 facing opposite the combustion chamber 98 (e.g., the cold side of the liner tile 120) to which a cooling flow may be directed, as discussed in greater detail herein.

The combustor liner support assembly 100A of FIG. 4 is positioned radially outward from the outer combustor liner 92. In the depicted embodiment, the combustor liner support assembly 100A includes a combustor liner support shell 130 that defines a lattice or framework arranged about the combustion chamber 98 radially outward from the liner tiles 120. The combustor liner support shell 130 includes a plurality of circumferentially-spaced axial combustor liner support members 132 and a plurality of axially-spaced circumferential combustor liner support members 134. The axial and circumferential combustor liner support members 132, 134 together define a grid structure onto which the liner tiles 120 are floatably mounted. In the illustrated embodiment of FIG. 4, the axial combustor liner support members 132 extend generally in the axial direction A and are spaced apart from each in the circumferential direction C, and the circumferential combustor liner support members 134 extend generally in the circumferential direction C and are spaced apart from each other in the axial direction A. As depicted in FIG. 4, the axial and circumferential combustor liner support members 132, 134 intersect each other at various circumferential and axial locations.

The combustor liner support shell 130 further defines a number of combustor liner support apertures 136. In the embodiment shown in FIG. 4, each combustor liner support aperture 136 is bounded by a pair of adjacent axial combustor liner support members 132 and a pair of adjacent circumferential combustor liner support members 134. These combustor liner support apertures 136 may be configured to allow passage of cooling air toward the liner tile outer surfaces 124 of the respective liner tiles 120. By way of non-limiting example, a cooling fluid, such as air bled from the compressor section, can be directed through the combustor liner support apertures 136 and impinge upon the liner tile outer surfaces 124 of the respective liner tiles 120. As such, local cooling effectiveness may be tailored to the geometry and thermal loading of each liner tile 120.

The combustor liner support assembly 100A includes a plurality of rails 140, each rail 140 extending generally in the radial direction R from the combustor liner support shell 130 toward the combustion chamber 98. Each rail 140 may be formed integrally with, or fastened to, select ones of the axial combustor liner support members 132 or circumferential combustor liner support members 134. The liner tiles 120 are floatably coupled to the rails 140 via one or more retainer assemblies 150. In the embodiment illustrated in FIG. 4, the retainer assemblies 150 are located at discrete points of the liner tiles 120 and may include, by way of non-limiting example, a fastener element such as a stud or bolt, and an associated bushing (not visible in FIG. 4), as will be further illustrated in subsequent figures. The floatable coupling enables the liner tiles 120 to move relative to the combustor liner support assembly 100A in response to thermal expansion or contraction, reducing stress concentration in the liner tiles 120 and at the interface between the liner tiles 120 and the combustor liner support shell 130. Embodiments of the present disclosure are beneficial for accommodating differences in thermal expansion coefficients between the structure of the liner tiles 120 and the combustor liner support shell 130, as well as between adjacent liner tiles 120.

The arrangement illustrated in FIG. 4 depicts the liner tiles 120 positioned adjacent one another in both the circumferential direction C and the axial direction A, with visible gaps therebetween that may be occupied by seal and support features, as discussed below. Adjacent liner tiles 120 each define a region therebetween that is at least partially spanned by one or more spline seals 160. Each spline seal 160 may extend axially and/or circumferentially between adjacent liner tiles 120, thus serving to inhibit migration of hot combustion gases past the seams or joints between liner tiles 120. For example, as shown in FIG. 4, at least one spline seal 160 may be received in a groove or channel defined at the lateral edge or surface of the liner tile 120. Each spline seal 160 is arranged such that it bridges the gap between adjacent liner tiles 120 and accommodates relative motion between the respective liner tiles 120 due to thermal effects. In the embodiment of FIG. 4, the spline seals 160 are disposed along each circumferential junction between the liner tiles 120 in a given row, as well as at axial joints between the liner tiles 120, providing an arrangement for sealing both circumferential and axial gaps. The precise cross-sectional shape and material of the spline seals 160 may be varied based on requirements for seal flexibility, life, and cooling performance.

In the embodiment of FIG. 4, the combustor assembly 80 further illustrates a clocked arrangement of the fuel cups 86 with respect to the liner tiles 120 and rails 140. Each fuel cup 86 is positioned at an axial forward location on the combustion chamber 98 and is circumferentially misaligned with respect to the rails 140 and the retainer assemblies 150. That is, the fuel cups 86 are offset from the radial projection of the rails 140 such that the repeated exposure of mounting features of the liner tiles 120 to the local heat flux associated with fuel injection and combustion is avoided. This arrangement may reduce the likelihood of excessive thermal gradients or thermal loading at the points where the liner tiles 120 are coupled to the rails 140 and improves the durability of the floating mounts and associated hardware. As an example, for a given annular row of the liner tiles 120, the fuel cups 86 may be disposed at circumferential intervals that are staggered with respect to the position of the rails 140. By way of non-limiting example, an axial centerline of the respective fuel cups 86 may be located circumferentially to substantially align with a circumferential midpoint of a particular liner tile 120. In other embodiments, a different pattern of circumferential misalignment may be selected according to the number of fuel cups 86 and liner tile 120 mounting locations. By way of non-limiting example, a quantity of the fuel cups 86 to the liner tiles 120 may be a 1:1 ratio such that each fuel cup 86 is located approximately at a circumferential midpoint of a respective liner tile 120. However, in exemplary embodiments, the quantity of the fuel cups 86 to the liner tiles 120 may not be a 1:1 ratio. By way of non-limiting example, there may be a greater quantity of fuel cups 86 than the liner tiles 120 in the circumferential direction C. In such an exemplary embodiment, there may be two, three, or more, fuel cups 86 per liner tile 120 in the circumferential direction. The circumferential placement of the fuel cups 86, circumferential span of the liner tile 120, or placement of the rails 140 may be such that the mounting features of the liner tiles 120 are circumferentially offset from a corresponding fuel cup 86 to reduce the likelihood of excessive thermal gradients or thermal loading at the points where the liner tiles 120 are coupled to the rails 140.

In the depicted embodiment of FIG. 4, a combustor liner channel 180 may be defined between adjacent liner tiles 120, particularly where the respective radial flanges of neighboring liner tiles 120A, 120B abut and define a channel for fluid movement or for accommodating seal elements such as the spline seals 160. The combustor liner channel 180 may also provide a path for the supply or migration of cooling air generally along the interface between liner tiles 120, or serve as a cavity for more complex sealing features.

The specific arrangement of the liner tiles 120 in two annular and circumferentially extending rows in FIG. 4 is provided as an example. In alternative embodiments, additional rows or patterns may be utilized, and the number, size, and geometry of individual liner tiles 120 may be varied. For example, the liner tiles 120 may be rectangular, trapezoidal, or another polygonal shape. The axial and circumferential extent of each liner tile 120 may be determined based on the combustor 84 size, the location and number of fuel cups 86, manufacturing considerations, or desired thermal resistance properties. In some embodiments, the liner tiles 120 may also vary in thickness to provide enhanced structural support or local cooling as needed.

The rails 140 may be configured in a variety of cross-sectional shapes. For example, in the embodiment shown in FIG. 4, the rails 140 may be substantially planar or elongate, but other shapes including U-shaped rails or T-shaped rails may be used as appropriate for the floatable coupling and retention of the liner tiles 120 to the combustor liner support shell 130. In exemplary embodiments, each rail 140 may include one or more rail legs, such as a first rail leg and a second rail leg, each extending radially toward the combustion chamber 98. The liner tiles 120 may, in such cases, be located between the rail legs and floatably retained by the retainer assembly 150, as will be detailed in other figures.

The combustor liner support apertures 136 may be distributed across the surface area of the combustor liner support shell 130 such that each liner tile 120 may receive a tailored amount of impingement cooling. By way of non-limiting example, areas proximate to the forward end 108 of the combustion chamber 98 (FIG. 3) may experience higher thermal loading, and as such, additional or enlarged combustor liner support apertures 136 may be provided to supply increased cooling airflow. Similarly, the circumferential spacing and density of the combustor liner support apertures 136 may be varied adjacent the spline seals 160 to manage cooling in the region proximate to the liner tile 120 joints.

The floatable coupling between the liner tiles 120 and the combustor liner support assembly 100A provided by the retainer assemblies 150 may permit each liner tile 120 to float or move relative to the rails 140 in the radial R, axial A, or circumferential C directions. Examples of floatable movement may include sliding or limited rotational freedom, depending on the precise geometry and elements of the retainer assembly 150 used. Such floatable coupling allows the liner tiles 120 to expand or contract independently during temperature cycling of the combustor 84. As depicted in FIG. 4, the spline seals 160 are visible as extending between adjacent liner tiles 120 along both the axial and circumferential seams between the liner tiles 120. As will be described in further detail below, one or more of the spline seals 160 may include one or more spline seal cooling features to allow a controlled flow of cooling air to pass directly through the spline seal 160 and be delivered to the region between neighboring liner tiles 120 and for film surface cooling of the liner tiles 120.

The overall assembly of the liner tiles 120, rails 140, retainer assemblies 150, and spline seals 160 as illustrated in FIG. 4 forms an annular segment of the outer combustor liner 92. It should be noted that a substantially similar arrangement may be adopted for the inner combustor liner 94, with the combustor liner support assembly 100B positioned radially inward. The described configuration may be incorporated into a variety of combustor types, including, for example, can-annular, annular, or hybrid forms, and adapted for different gas turbine engine architectures. Further, the modular approach to the combustor assembly 80 allows for the replacement or refurbishment of individual liner tiles 120 in service, if desired, without replacing the full combustor liner 90. Each liner tile 120 is coupled to the support structure in a manner that permits thermal growth in the axial A, radial R, and circumferential C directions within operational limits.

Figure 5:
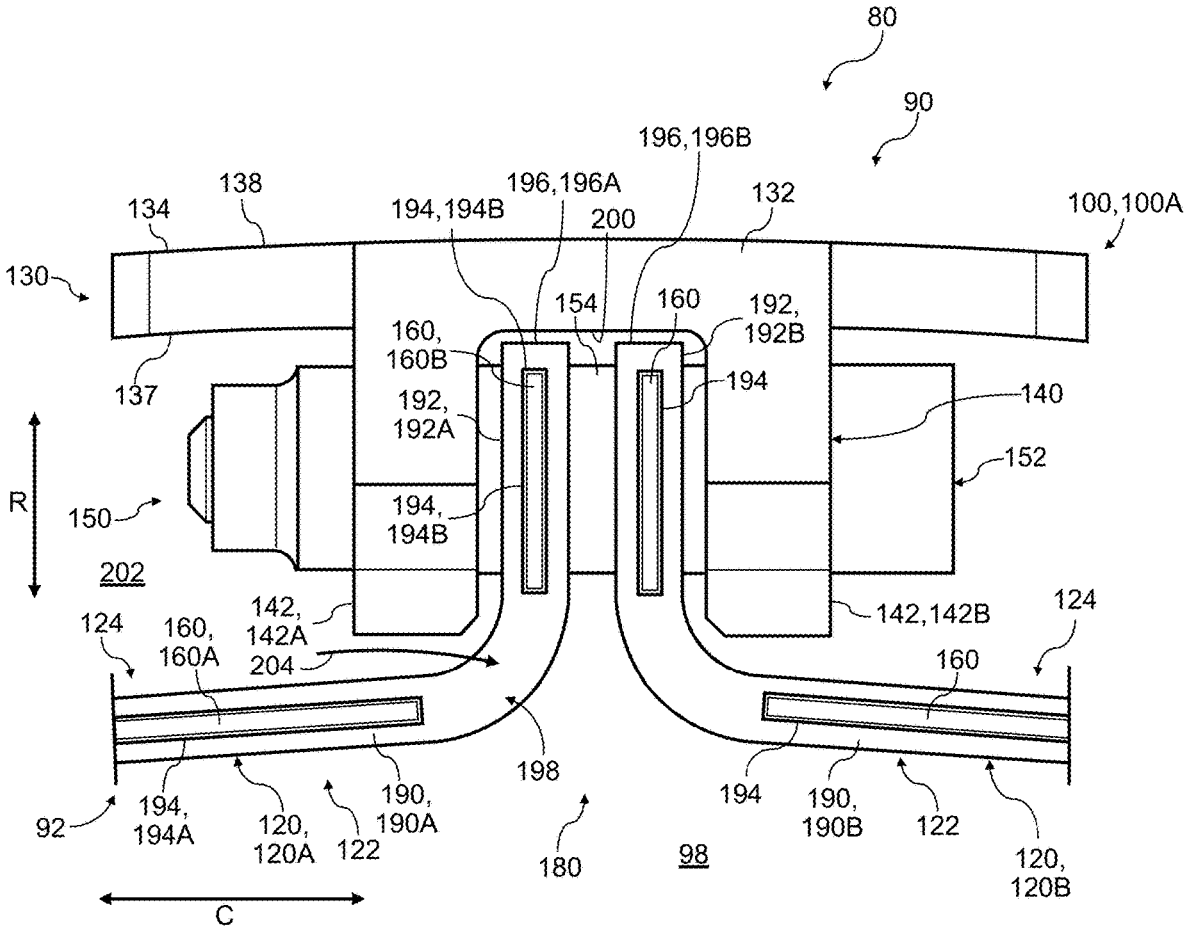
FIG. 5 is a schematic view of a portion of an exemplary combustor assembly in accordance with embodiments of the present disclosure.

FIG. 5 is a schematic view of an embodiment of the retainer assembly 150 for floatably coupling one or more of the liner tiles 120 of the outer combustor liner 92 to the combustor liner support assembly 100A in accordance with the present disclosure. The exemplary structure of FIG. 5 may be configured in substantially the same manner as the combustor assembly 80, the combustor liner 90, the liner tiles 120, and combustor liner support assembly 100A illustrated and described in the embodiments of FIGS. 2-4, and accordingly, the same or similar numbers may refer to the same or similar parts. By way of non-limiting example, the combustor assembly 80 of FIG. 5 generally includes the outer combustor liner 92 constituted by a plurality of the liner tiles 120, the combustor liner support shell 130 defining a plurality of the axial combustor liner support members 132 and a plurality of the circumferential combustor liner support members 134, and a plurality of the rails 140 extending radially toward the combustion chamber 98. However, for the embodiment of FIG. 5, specific details of the floatable coupling structure, including the configuration of the retainer assembly 150, are illustrated in detail.

The combustor liner support assembly 100A of FIG. 5 includes the combustor liner support shell 130, with at least one circumferential combustor liner support member 134 and at least one axial combustor liner support member 132. In the embodiment illustrated in FIG. 5, the combustor liner support assembly 100A supports a pair of adjacent liner tiles 120A and 120B. The liner tiles 120A, 120B each include a liner tile panel 190 (with 190A referring to the liner tile panel of the liner tile 120A and 190B referring to the liner tile panel of the liner tile 120B) defining the liner tile inner surface 122 and the oppositely disposed liner tile outer surface 124. The liner tiles 120 are arranged such that their respective liner tile inner surfaces 122 collectively face the combustion chamber 98, and their liner tile outer surfaces 124 face radially outward away from the combustion chamber 98 and toward the combustor liner support shell 130. Correspondingly, the combustor liner support shell 130 defines a combustor liner support shell inner surface 137 facing the combustion chamber 98 (e.g., a hot side of the combustor liner support shell 130) and a combustor liner support shell outer surface 138 opposite the combustor liner support shell inner surface 137 facing away from the combustion chamber 98 (e.g., the cold side of the combustor liner support shell 130). In the embodiment depicted in FIG. 5, the liner tiles 120 include a pair of radial flanges 192 that extend radially from opposing circumferential ends of the liner tile panel 190 away from the combustion chamber 98 and toward the combustor liner support shell 130 (only one radial flange 192 is depicted for each of the liner tiles 120A, 120B in FIG. 5 identified as radial flanges 192A, 192B, respectively).

The combustor liner support assembly 100A further includes the rail 140 configured as a U-shaped rail. The rail 140 extends radially inward toward the liner tile outer surface 124 of a respective liner tile 120. The U-shaped rail 140 depicted in FIG. 5 includes a pair of spaced-apart rail legs (defined as rail legs 142A, 142B in FIG. 5), each extending radially from the axial combustor liner support member 132 toward the combustion chamber 98. The U-shaped rail 140 is oriented such that the open end of the U-shaped rail 140 faces the combustion chamber 98 and provides sidewalls for receiving the retainer assembly 150. The space between the rail legs 142A, 142B forms a channel or cavity for receiving portions of the liner tiles 120. In the embodiment illustrated in FIG. 5, at least a portion of the retainer assembly 150 is located within the U-shaped rail 140 and includes a fastener element 152 extending through the rail legs 142A, 142B. A bushing 154 is mounted on the fastener element 152 and is positioned between the rail legs 142A, 142B. The embodiment of FIG. 5 illustrates that the bushing 154 extends through the radial flanges 192A, 192B (extending from respective liner tile panels 190A, 190B) to floatably couple the adjacent liner tiles 120A, 120B to the combustor liner support assembly 100A. The bushing 154 may extend through apertures formed in the respective radial flanges 192A, 192B (not illustrated in FIG. 5) such that a defined clearance between the respective radial flanges 192A, 192B with respect to the bushing 154 is provided to enable thermal expansion of the liner tiles 120A, 120B in the radial direction R and the axial direction A (in-and-out of the page in FIG. 5). Thus, in the exemplary embodiment depicted in FIG. 5, the bushing 154 includes a bore (not explicitly shown in FIG. 5) that extends longitudinally in the circumferential direction C, along with a longitudinal length of the fastener element 152 such that the fastener element 152 extends through the bore in the bushing 154. In exemplary embodiments, a predefined clearance is provided between the respective radial flanges 192A, 192B, and between the respective rail legs 142A,142B and the respective radial flanges 192A, 192B to enable thermal expansion of the liner tiles 120A, 120B in the circumferential direction C. In the embodiment illustrated in FIG. 5, each radial flange 192A, 192B defines a radially outward face 196 (depicted as respective radially outward faces 196A, 196B) extending toward an inner surface 200 of rail 140 defined between the rail legs 142A, 142B. In exemplary embodiments, a defined gap is maintained between the inner surface 200 and the radially outward faces 196A, 196B to limit fluid leakage between the liner tiles 120A, 120B and, if needed, enable a cooling fluid to flow from a cavity 202 defined between the liner tiles 120A, 120B and the combustor liner support shell 130 to the retainer assembly 150. Thus, in exemplary embodiments, the liner tiles 120A, 120B are floatably coupled to the combustor liner support shell 130 to enable thermal expansion of the liner tiles 120A, 120B in one or more of the axial direction A (in-and-out of the page in FIG. 5), the radial direction R, and the circumferential direction C.

The floatable coupling achieved by the arrangement of the bushing 154 and fastener element 152 allows the radial flanges 192A, 192B of the liner tiles to move, to a limited degree, relative to the rail 140 and the combustor liner support assembly 100A. For example, in the embodiment of FIG. 5, the radial flanges 192A, 192B may displace radially or circumferentially (as indicated by the R and C directions) or axially (in-and-out of the page of FIG. 5) with respect to the rail 140 and the combustor liner support shell 130. This floatable engagement permits each liner tile 120 to independently accommodate thermal expansion or contraction, reducing potential for thermally-induced stress or distortion while maintaining alignment of the liner tiles 120 in the outer combustor liner 92. In the embodiment illustrated in FIG. 5, the retainer assembly 150 extends in the circumferential direction C and, therefore, is substantially shielded from hot combustion gases in the combustion chamber 98. By way of non-limiting example, the fastener element 152 is positioned circumferentially and shielded from the hot combustion gases in the combustion chamber 98 by the liner tiles 120 and the bushing 154. In the embodiment illustrated in FIG. 5, the retainer assembly 150 is located on the hot side of the combustor liner support shell 130. In other words, the retainer assembly 150 is radially located toward the combustion chamber 98 with respect to the combustor liner support shell inner surface 137. Therefore, the retainer assembly 150 is at least partly located between the liner tiles 120 and the combustor liner support shell inner surface 137. As depicted in FIG. 5, the rail legs 142A,142B extend from the axial combustor liner support member 132 toward the liner tile outer surface 124.

As depicted in FIG. 5, the configuration of the bushing 154 between the rail legs 142A,142B allows the retainer assembly 150 to accommodate differential thermal growth of the liner tiles 120 relative to the combustor liner support shell 130. By way of non-limiting example, as temperatures within the combustion chamber 98 vary during operation, the material of the liner tiles 120 may expand or contract independently from the support structure. The floatable coupling provided by the bushing 154 enables the radial flanges 192A,192B to move with respect to the combustor liner support assembly 100A. In some embodiments, the bushing 154 may be constructed from a compliant or thermally stable material to further facilitate float and accommodate mechanical tolerances.

The embodiment of FIG. 5 further illustrates that each liner tile 120 may include one or more spline seal channels 194 configured to receive a respective spline seal 160. In the embodiment depicted in FIG. 5, the liner tile 120A includes two spline seal channels 194 identified as the spline seal channels 194A, 194B. The spline seal channel 194A is located along an edge of the liner tile panel 190A, and the spline seal channels 194B is located along an edge of the radial flange 192A. The spline seal channels 194A, 194B are configured to receive spline seals 160A, 160B, respectively. In exemplary embodiments, the spline seal 160A is located or fits in the spline seal channel 194A of the liner tile panel 190A and extends toward and engages a respective spline seal channel 194 in the liner tile panel 190 of an adjacent liner tile 120 located in the axial direction A (in-and-out of the page in FIG. 5). Similarly, the spline seal 160B, for example, located or fits in the spline seal channel 194B of the radial flange 192A and extends toward and engages a respective spline seal channels 194 in the radial flange 192 of an adjacent liner tile 120 located in the axial direction A (in-and-out of the page in FIG. 5). Thus, the spline seals 160 form a compliant barrier between adjacent liner tiles 120. The spline seals 160 inhibit the migration of hot combustion gases through the gaps between the liner tiles 120 while enabling the relative movement between adjacent liner tiles 120 facilitated by the floatable mounting.

A combustor liner channel 180 is defined between the adjacent liner tiles 120A, 120B. In the example shown in FIG. 5, the combustor liner channel 180 extends in the axial direction (in-and-out of the page of FIG. 5) and is formed in a region where the respective liner tile panels 190A, 190B transition to the respective radial flanges 192A, 192B. In the embodiment of FIG. 5, the circumferential location of the combustor liner channel 180 may be offset, or "clocked," with respect to the position of the fuel cups 86 (FIGS. 3 and 4). In other words, the circumferential location of the radial flanges 192A, 192B may be offset or misaligned with respect to the circumferential position of the fuel cups 86 (FIGS. 3 and 4). In this arrangement, the combustor liner channel 180 is not circumferentially aligned with a particular fuel cup 86 (FIGS. 3 and 4), which may reduce the thermal loading on the retainer assembly 150 and associated structure. For example, by offsetting the combustor liner channel 180 from the position of the fuel cups 86 (FIGS. 3 and 4), regions of elevated heat near the fuel injection are not superimposed on the region of the liner tile where the liner tile is attached to the support structure (e.g., the combustor liner support shell 130), potentially improving durability and operational life.

The embodiment of FIG. 5 also illustrates a spline seal gap 198 that is defined between the spline seals 160A, 160B where the liner tile 120A transitions or bends from the liner tile panel 190A to the radial flange 192A. The presence of the spline seal gap 198 provides a controlled path for the flow of cooling fluid, for example, air, which may be routed through the combustor support shell 130 and into the cavity 202. The cooling fluid may be directed through the spline seal gap 198 and toward the liner tile inner surface 122, as indicated by a flow direction 204, to provide film cooling of the combustor liner 90 and/or be used to cool the region near the retainer assembly 150 and the floatably mounted radial flanges 192A, 192B.

The combustor liner tile panel 190A, 190B, the radial flanges 192A, 192B, the U-shaped configuration of rail 140, and the presence of bushings 154 enable a retainer assembly 150 that allows multi-directional float of the liner tile 120 attachments, as required for operation over a range of thermal conditions. In exemplary embodiments, the fastener element 152 may be a threaded stud, a bolt, or a pin configured to accommodate both the static loads due to pressure differential across the combustor liner 90 as well as any dynamic or thermal loads, while the bushing 154 is configured to permit local rotation or limited translation of the liner tiles 120.

It is to be appreciated that, while a U-shaped rail 140 is illustrated in the specific embodiment of FIG. 5, other forms of rail geometry may be utilized for floatable coupling, including, for example, T-shaped rails (as described in association with other figures or claims), flat rails, or complex, multi-flanged profiles. In instances with T-shaped rails, for example, adjacent liner tiles may each be floatably coupled to opposing sides of the rail leg, optionally using a retainer assembly similar in function to that depicted. Also, while the bushing 154 is illustrated as a single element located between the rail legs 142A, 142B, multiple bushings or alternative resilient elements could be incorporated to further tailor the degree or directionality of float allowed for each liner tile.

The liner tile 120 and associated spline seal channels 194 may be configured for a variety of spline seal 160 profiles, including flat, rounded, or stepped seals, and may be fabricated from metallic alloys or, for non-metallic liner tiles, from ceramic matrix composites or other advanced materials, depending on the combustor operating environment.

The embodiment of FIG. 5, while directed to the outer combustor liner 92, may also be applied to the inner combustor liner 94, with the combustor liner support assembly 100B (FIGS. 2 and 3) and corresponding rails, bushings, and retainer assemblies positioned radially inward. In such embodiments, the directionality of the floatable mounting (relative to the combustion chamber) would be inverted, but the function and relative arrangement of the elements would remain substantially similar.

In summary, FIG. 5 illustrates in detail an embodiment in which adjacent liner tiles 120 are floatably coupled using the retainer assembly 150—comprising a fastener element 152 and bushing 154—to a U-shaped rail 140 of the combustor liner support assembly 100A. The illustrated configuration allows multi-directional movement of the liner tiles 120, incorporates interposed spline seals 160 in spline seal channels 194 of the liner tiles 120, and forms cooling paths such as a combustor liner channel 180 and a spline seal gap 198 to facilitate controlled cooling and thermal stress management at the retainer assembly interface. Alternative variations and supplementary features (e.g., cooling apertures, bushing geometries, supplemental seals) may be incorporated to further tailor the thermal, structural, or operational characteristics within the scope of the present disclosure.

Figure 6:
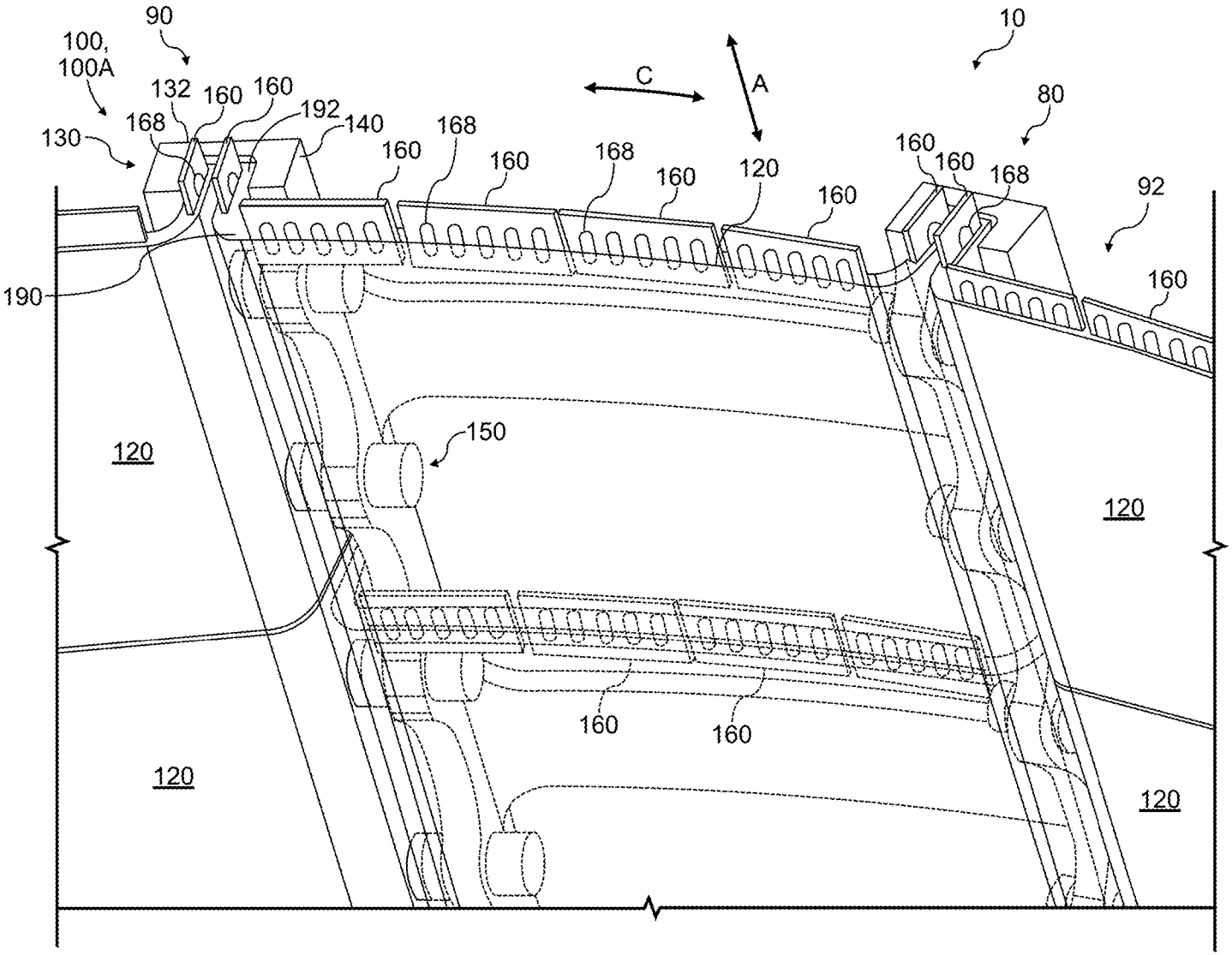
FIG. 6 is a schematic view of a portion of an exemplary combustor assembly in accordance with embodiments of the present disclosure.

FIG. 6 depicts a schematic view of a portion of the combustor assembly 80 in accordance with an exemplary aspect of the present disclosure. The exemplary combustor assembly 80 of FIG. 6 may be configured in substantially the same manner as the exemplary structures illustrated in FIGS. 4 and 5, and accordingly, the same or similar numbers may refer to the same or similar parts. For example, the combustor assembly 80 of FIG. 6 generally includes the outer combustor liner 92 formed by a plurality of liner tiles 120 that are floatably coupled to the combustor liner support assembly 100A. However, for the embodiment of FIG. 6, the illustration specifically focuses on the arrangement and features of a plurality of spline seals 160 positioned between adjacent liner tiles 120, and particularly illustrates that the spline seals 160 include one or more spline seal cooling apertures 168.

In the embodiment depicted in FIG. 6, the plurality of liner tiles 120 are positioned adjacent each other in the circumferential direction C and the axial direction A. The spline seals 160 are located and extend between adjacent liner tiles 120. In the illustrated embodiment of FIG. 6, the spline seals 160 are shown seated in the liner tile panels 190 and the radial flanges 192 of the respective liner tiles 120. Thus, the spline seals are generally located at the junctions or interfaces between adjacent liner tiles 120.

Each of the spline seals 160 in FIG. 6 includes a series of spline seal cooling apertures 168. The spline seal cooling apertures 168 are depicted as a plurality of openings passing through the body of the spline seal 160, arranged to provide a fluid communication path between the region outside the combustor liner 90 and the joint between the adjacent liner tiles 120. These cooling apertures 168 may be beneficial for providing directed cooling airflow along the interface of the liner tiles 120 and the spline seals 160. For instance, pressurized cooling air from outside the combustor liner 90 can be directed through the spline seal cooling apertures 168, impinging upon, or flowing along, the surfaces of the liner tiles 120 and the spline seals 160, thereby reducing the thermal load experienced at these locations.

The combination of spline seals 160 with spline seal cooling apertures 168 provides a number of useful features. First, the spline seals 160 act as compliant barriers that inhibit the migration of hot combustion gases through the seams or joints formed between adjacent liner tiles 120. Second, the spline seal cooling apertures 168 introduce a mechanism to deliver localized impingement or film cooling air to these junctions, which may be beneficial for maintaining the operability of both the spline seals 160 and the liner tiles 120 under high temperature conditions found in the combustion chamber 98 (FIG. 3). As illustrated in FIG. 6, retainer assemblies 150 are also visible, positioned in association with the combustor liner support shell 130 for floatably coupling the liner tiles 120 to the combustor liner support assembly 100A.

It should be noted that the number, shape, and arrangement of the spline seal cooling apertures 168 are not limited to the particular embodiment shown in FIG. 6. In alternative embodiments, the spline seal cooling apertures 168 may be configured as slots, holes, or other opening profiles. The size, spacing, and orientation of these spline seal cooling apertures 168 may be selected based on local cooling requirements, the thermal expansion characteristics of the liner tiles 120, as well as the pressure and temperature operating environment.

In the embodiment of FIG. 6, the spline seals 160 are positioned so that they span adjacent liner tiles 120, such as between the liner tile panels 190 and/or between respective radial flanges 192. In some alternative embodiments, the quantity of spline seal cooling apertures 168 may vary across the length of a given spline seal 160. For example, in portions of the combustor liner 90 experiencing greater thermal loading or requiring increased cooling, the density of spline seal cooling apertures 168 may be increased. Conversely, in regions subject to lesser heat flux, fewer spline seal cooling apertures 168 may be provided. The flexibility of the arrangement allows localized adjustment for cooling performance.

The floating nature of the liner tiles 120, retained by the retainer assemblies 150 and supported on the rails 140, allows for differential movement among the liner tiles 120 under thermal expansion and contraction. The inclusion of spline seal cooling apertures 168 in the spline seals 160 may further improve system durability by reducing thermal gradients at the liner tile 120 interfaces and at the supporting structures. For instance, as the liner tiles 120 displace slightly due to temperature changes, the geometry of the spline seals 160 and their spline seal cooling apertures 168 may flex to accommodate this movement while still providing effective sealing and cooling.

The specific form of the spline seal 160 may include a planar strip, a curved or stepped profile, or other shapes, as required for a given application. In one example, the spline seal 160 may be formed from a metal alloy, a ceramic, or a composite material suitable to withstand the combustor environment. The spline seal cooling apertures 168 may be manufactured via processes such as laser drilling, mechanical drilling, punching, or integrated into the forming process of the spline seal 160.

In exemplary embodiments, the spline seal cooling apertures 168 are positioned to be at least partially obscured by the adjacent liner tiles 120 at a first, lower temperature. As the combustor assembly 80 heats up and the spacing between liner tiles 120 increases due to thermal expansion, a greater portion of the spline seal cooling aperture 168 may be exposed, thereby increasing the delivery of cooling airflow to respective regions of the liner tiles 120.

The embodiment of FIG. 6, by providing a detailed illustration of spline seals 160 and spline seal cooling apertures 168, demonstrates an arrangement suitable for reducing leakage of combustion gases, improving cooling of the liner tiles 120 and areas where the liner tiles 120 are positioned adjacent each other, and accommodating thermal expansion of the liner tiles 120 in a floatably mounted combustor liner support system. Variations may include different numbers, placements, and sizes of spline seals 160 and associated spline seal cooling apertures 168, as well as adjustments to the mounting locations for the retainer assemblies 150 or materials of construction.

Alternative embodiments may further include one or a plurality of spline seals 160 extending from a single liner tile panel 190 or radial flange 192 to adjacent liner tiles 120, with each spline seal 160 including an independent set of spline seal cooling apertures 168 or being devoid of the spline seal cooling apertures 168. For instance, a first spline seal 160 may be positioned at the radial flange 192, a second spline seal 160 positioned along the liner tile panel 190, and a third spline seal 160 positioned at an opposite radial flange 192. In such cases, one or more of the spline seals 160 may include a plurality of spline seal cooling apertures 168 to tailor the cooling airflow for different parts of the combustor assembly 80.

In summary, FIG. 6 illustrates an embodiment of a combustor assembly 80 in which spline seals 160 extend between adjacent liner tiles 120, and the spline seals 160 may include one or more spline seal cooling apertures 168. This configuration facilitates controlled cooling airflow at the junctions of liner tiles 120, limits the migration of combustion gases, and accommodates expansion and contraction of the liner tiles 120, all while supporting the floatable mounting arrangement provided by the retainer assemblies 150 and rails 140 on the combustor liner support shell 130. The features and alternatives described herein may be adapted as needed for a wide range of gas turbine engine applications within the present disclosure.

Figure 7:
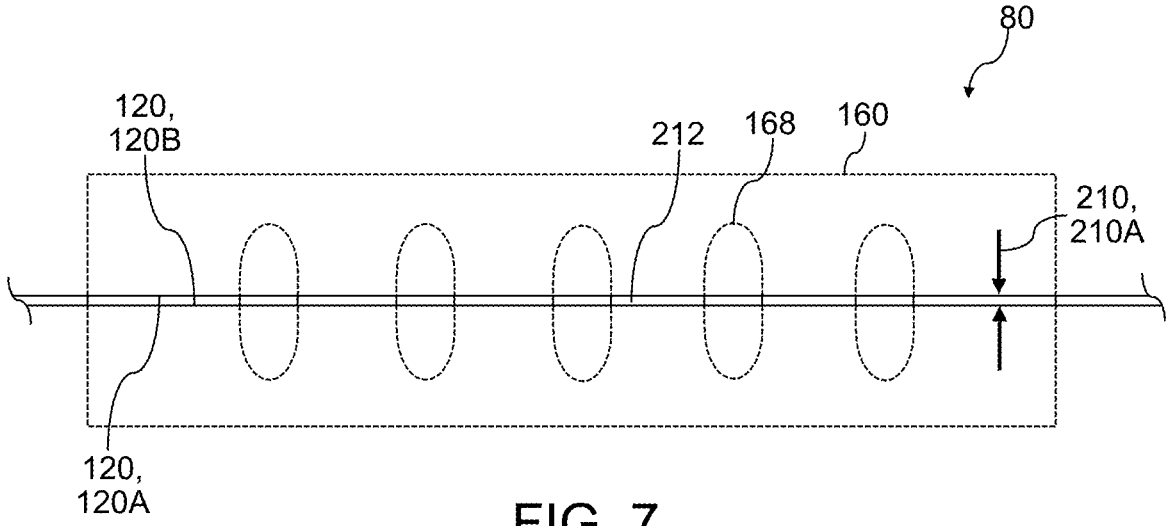
FIG. 7 is a schematic view of a portion of an exemplary combustor assembly in accordance with embodiments of the present disclosure.

FIG. 7 depicts a schematic view of a spline seal 160 arrangement in a portion of a combustor assembly 80 in accordance with an exemplary aspect of the present disclosure. The exemplary combustor assembly 80 of FIG. 7 may be configured in substantially the same manner as the exemplary structures described with respect to FIGS. 4-6, and accordingly, the same or similar numbers may refer to the same or similar parts. For example, the exemplary combustor assembly 80 of FIG. 7 generally includes a plurality of liner tiles 120, with individual liner tiles 120A and 120B, and one of the spline seals 160 positioned between the adjacent liner tiles 120A, 120B. The spline seal 160 depicted in FIG. 7 may be located in the liner tile panel 190 (FIGS. 5 and 6) and/or the radial flange 192 (FIGS. 5 and 6) of the liner tiles 120A, 120B. However, for the embodiment of FIG. 7, the illustration focuses specifically on the arrangement of the spline seal 160 with spline seal cooling apertures 168 at a first temperature within the combustion chamber 98, and on a liner tile spacing 210 (referenced as liner tile spacing 210A in FIG. 7) between the adjacent liner tiles 120A, 120B.

In the embodiment of FIG. 7, the liner tiles 120A and 120B are positioned adjacent to one another with a defined liner tile spacing 210A therebetween. The liner tile spacing 210 may change with temperature, as the liner tiles 120 expand and contract in service. The spline seal 160 is shown extending between the adjacent liner tiles 120A, 120B to inhibit the passage of hot gases through a gap 212 defined by the spacing 210A. In this view, a plurality of spline seal cooling apertures 168 are defined through the spline seal 160. These spline seal cooling apertures 168 extend, for example, as a series of openings with a generally elliptical or elongated profile, and may be arranged along a longitudinal length of the spline seal 160.

At the first temperature, the width of the liner tile spacing 210A is such that a substantial portion of each spline seal cooling aperture 168 is covered or obscured by the respective adjacent edges of the liner tiles 120A and 120B. In this arrangement, only a partial area of each spline seal cooling aperture 168, if any, is exposed to the gap 212 for the flow of cooling air.

The exposure of the spline seal cooling apertures 168 to cooling airflow is functionally dependent on the liner tile spacing 210, which in turn is dependent on the thermal conditions experienced by the combustor assembly 80. For instance, at lower or ambient temperatures, the spacing 210 may be relatively small due to minimal thermal expansion, and the majority or entirety of the area of the spline seal cooling apertures 168 remains covered by the adjacent edges of the liner tiles 120. As the temperature rises during engine operation, the liner tiles 120A, 120B and/or the structure supporting the liner tiles 120A, 120B (e.g., the combustor liner support shell 130 (FIGS. 4-6) may expand, resulting in an increased liner tile spacing 210 and consequently exposing a greater portion of each spline seal cooling aperture 168 to a cooling flowpath, thereby allowing increased delivery of cooling fluid through the spline seal cooling apertures 168. This dynamic exposure of the spline seal cooling apertures 168 provides increased cooling fluid delivery precisely at those junctures where thermally-induced gaps are greatest and seal cooling is important. This self-adjusting cooling airflow delivery may be beneficial for matching the cooling capacity to periods of higher thermal load, while limiting unnecessary coolant flow when the combustor is cold, thereby improving overall efficiency.

In alternative embodiments, the size, shape, and distribution of the spline seal cooling apertures 168 may be varied to tailor the desired cooling airflow as a function of expected liner tile 120 movement. For instance, in certain combustor zones experiencing greater thermal gradients or higher expansion, additional or enlarged spline seal cooling apertures 168 may be included along the spline seal 160. Likewise, some spline seals 160 may omit the spline seal cooling apertures 168 in regions where cooling loads are comparatively low. The profile of the spline seal cooling apertures 168 may be oval, circular, slotted, or other geometries depending on selected manufacturing techniques and local structural or cooling requirements. The variable exposure of the spline seal cooling apertures 168 as a function of liner tile 120 temperature and expansion, as depicted in FIG. 7, allows for a passive and responsive cooling system. This system increases the likelihood that elevated thermal conditions will result in increased cooling fluid delivery precisely at those junctures where thermally-induced gaps are greatest and seal cooling is most important. In this way, the arrangement may improve reliability and thermal management in the combustor assembly 80 without requiring active flow control components.

Figure 8:
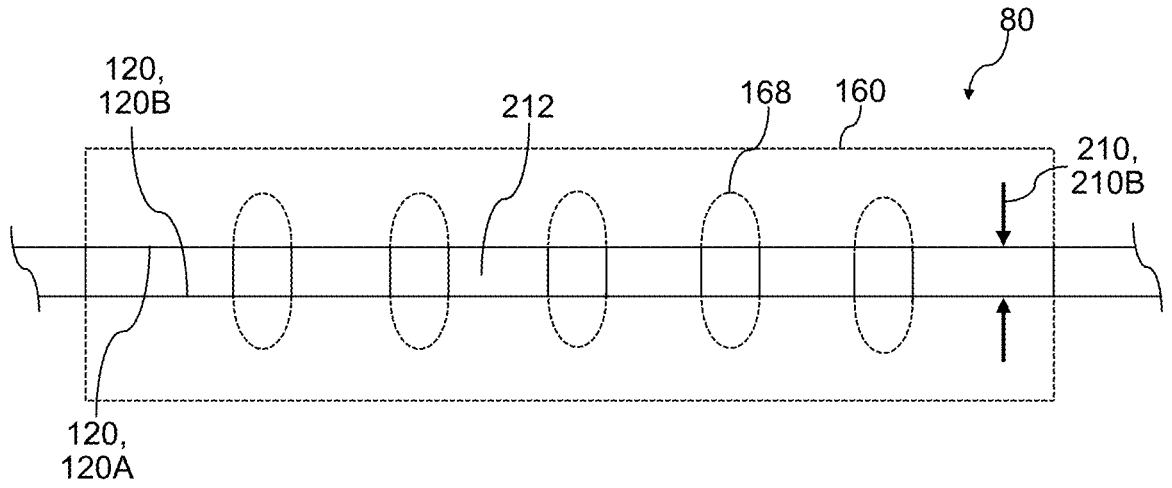
FIG. 8 is a schematic view of a portion of an exemplary combustor assembly in accordance with embodiments of the present disclosure.

FIG. 8 depicts a schematic view of the spline seal 160 arrangement in a portion of the combustor assembly 80 in accordance with an exemplary aspect of the present disclosure. The exemplary combustor assembly 80 of FIG. 8 may be configured in substantially the same manner as the exemplary structure of FIG. 7, and accordingly, the same or similar numbers may refer to the same or similar parts. For example, the exemplary combustor assembly of FIG. 8 generally includes a plurality of liner tiles 120, with adjacent liner tiles 120A, 120B, and the spline seal 160 located between the adjacent liner tiles 120A, 120B. However, for the embodiment of FIG. 8, the schematic diagram particularly illustrates the arrangement of the spline seal 160 with a plurality of spline seal cooling apertures 168 positioned at a second temperature (e.g., greater or higher than the first temperature as described in connection with FIG. 7) such that at least a portion of each spline seal cooling aperture 168 is at least partially unobscured due to a larger liner tile spacing 210B than the liner tile spacing 210A depicted in FIG. 7. Thus, for example, when the combustor 84 (FIG. 3) experiences thermal expansion and the gap 212 between adjacent liner tiles 120, 120B increases, a greater portion of each spline seal cooling aperture 168 is exposed, enabling increased cooling airflow through the spline seal cooling apertures 168.

Figure 9:
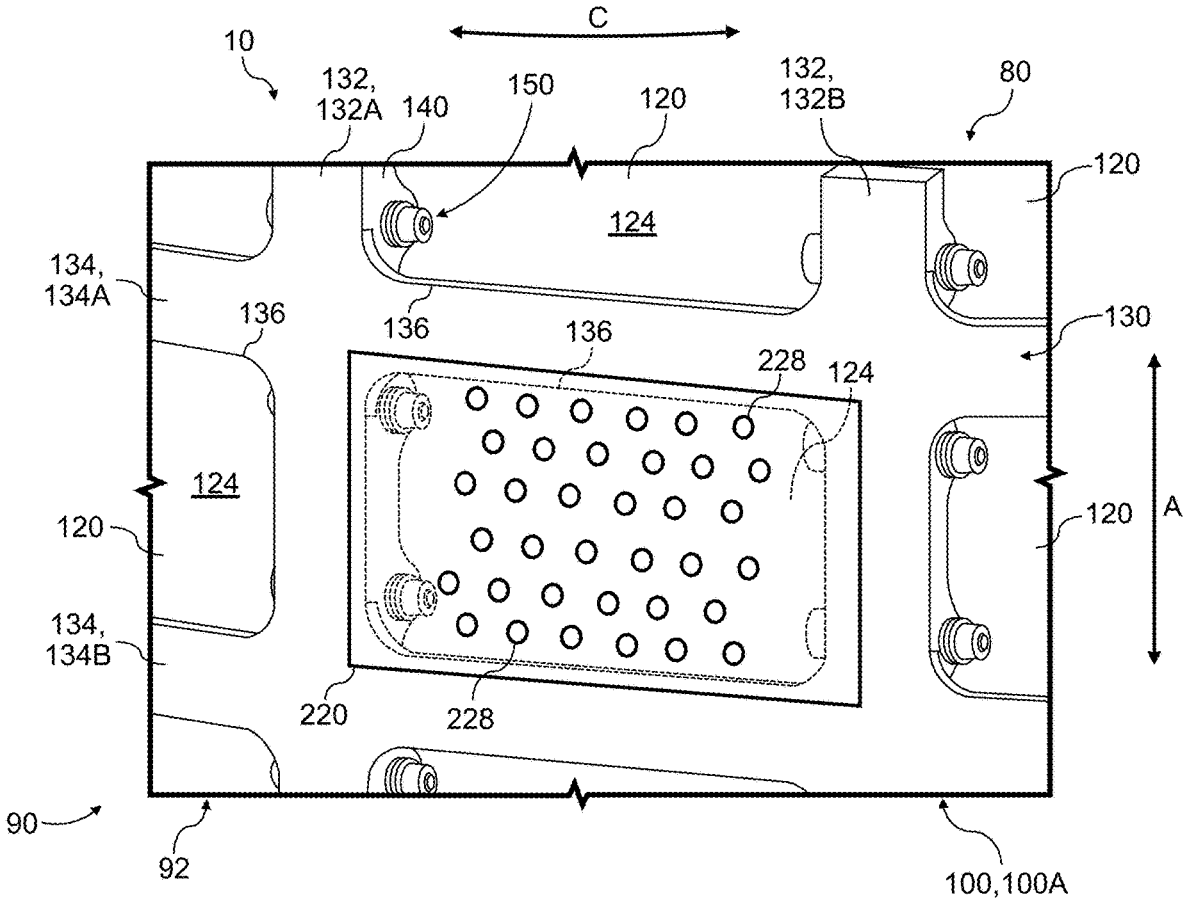
FIG. 9 is a schematic view of a portion of an exemplary combustor assembly in accordance with embodiments of the present disclosure.

FIG. 9 depicts a schematic view of a portion of the combustor assembly 80 in accordance with an exemplary aspect of the present disclosure. The exemplary combustor assembly 80 of FIG. 9 may be configured in substantially the same manner as the exemplary combustor assemblies described in previous figures, and accordingly, the same or similar reference numerals may refer to the same or similar parts. For example, the combustor assembly 80 of FIG. 9 generally includes the combustor liner 90, generally defining the outer combustor liner 92, with a plurality of the liner tiles 120, the combustor liner support shell 130 having a plurality of the axial combustor liner support members 132 and the circumferential combustor liner support members 134, a plurality of the rails 140, and the retainer assemblies 150 floatably coupling the liner tiles 120 to the rails 140. In the embodiment of FIG. 9, the combustor assembly 80 further includes one or more support shell panels 220 spaced radially outward from the liner tile outer surface 124 of a respective liner tile 120, and the support shell panel 220 defines a plurality of impingement apertures 228 arranged to direct a cooling fluid to the liner tile 120.

In the embodiment illustrated in FIG. 9, the combustor liner support shell 130 includes a network of circumferentially-spaced axial combustor liner support members 132 intersecting with axially-spaced circumferential combustor liner support members 134. This intersection defines a grid arrangement in the combustor liner support shell 130. At least one combustor liner support aperture 136 is shown being defined by a pair of axial combustor liner support members 132 (identified as axial combustor liner support members 132A, 132B in FIG. 9), and a pair of circumferential combustor liner support members 134 (identified as circumferential combustor liner support members 134A, 134B in FIG. 9), forming an opening for fluid communication with the liner tile outer surface 124 of a respective liner tile 120. In the embodiment of FIG. 9, these combustor liner support apertures 136 are positioned such that at least a portion of the cooling fluid may flow through the combustor liner support shell 130 proximate to the liner tile outer surface 124 of the liner tiles 120.

The combustor assembly 80 of FIG. 9 further includes the support shell panel 220 disposed in a radially spaced apart position with respect to the liner tile outer surface 124. The support shell panel 220 is coupled to the combustor liner support shell 130, such as by attachment to the pairs of axial combustor liner support members 132 and circumferential combustor liner support members 134. In this manner, the support shell panel 220 extends across the combustor liner support aperture 136, creating a defined cavity or plenum between the support shell panel 220 and the respective liner tile 120. The spacing between the support shell panel 220 and the liner tile 120 is selected to permit suitable flow of a cooling fluid, such as air, through the impingement apertures 228 and onto the liner tile outer surface 124.

In the embodiment of FIG. 9, the support shell panel 220 includes the plurality of impingement apertures 228 distributed across its area. The impingement apertures 228 are configured to control the velocity, direction, and distribution of cooling fluid impinging upon the liner tile outer surface 124. For example, the impingement apertures 228 may be circular, slotted, or other cross-sectional shapes as desired for specific cooling coverage and flow rate. The arrangement and density of the impingement apertures 228 may be varied to suit localized thermal loading, manufacturing capabilities, or desired cooling patterns. For instance, regions of higher thermal stress may have a greater number of impingement apertures 228 concentrated over the corresponding portions of the liner tile 120. The support shell panel 220 may also be a solid panel being devoid of impingement apertures 228 based on specific cooling needs.

The support shell panel 220 may be fabricated as a solid sheet, as depicted, or may include additional features such as offsets, stiffening ribs, or multi-layered structures for mechanical or thermal performance. In some embodiments, the support shell panel 220 is formed as a single piece; in other embodiments, it may be fabricated from multiple interconnected pieces to accommodate manufacturing constraints or segmented maintenance approaches. By way of example, the support shell panel 220 may cover a single combustor liner support aperture 136 or may extend across a plurality of combustor liner support aperture 136. The arrangement of FIG. 9 shows that the support shell panel 220 is spaced apart from the liner tile outer surface 124, enabling impingement cooling of the liner tile 120. The support shell panel 220 may also be provided to provide a desired pressure drop across the respective liner tile 120. Cooling fluid passes through the impingement apertures 228 in the support shell panel 220, enters through the combustor liner support aperture 136 defined by the supporting grid of the axial and circumferential combustor liner support members 132, 134, and contacts the liner tile outer surface 124. This fluid flow removes heat from the liner tile 120 before the fluid is exhausted or recirculated, depending on the broader cooling system arrangement. The configuration of the support shell panel 220 and impingement apertures 228 can be tailored to provide uniform or non-uniform cooling as required. In one example, a particular liner tile 120 subject to elevated local heat flux may be provided with a dedicated support shell panel 220 with a greater density of closely spaced impingement apertures 228 to selectively increase cooling in that region. In another example, multiple support shell panels 220, each with different patterns or sizes of impingement apertures 228, may be installed to support zoned or variable cooling strategies across the combustor liner 90.

In the embodiment of FIG. 9, the support shell panel 220 is positioned radially outward of a single combustor liner support aperture 136, but it should be understood that the support shell panel 220 may be located at a plurality of locations in common with a plurality of different combustor liner support apertures 136. In alternative embodiments, not every combustor liner support aperture 136 is required to have a corresponding support shell panel 220.

The use of the support shell panels 220 as shown in FIG. 9 is considered optional and may be varied in scope, size, number, or position for different combustor liner 90 geometries and operational requirements. In some embodiments, the support shell panel 220 can be removably or replaceably attached to the combustor liner support shell 130 to facilitate inspection or maintenance. In other versions, the support shell panel 220 may be permanently affixed or integrally formed with a portion of the combustor liner support shell 130.

The spacing between the support shell panel 220 and the liner tile outer surface 124, as well as the arrangement of the impingement apertures 228, may be selected to optimize impingement jet characteristics, such as jet Reynolds number, stagnation pressure, and local cooling effectiveness. For example, the gap may range from less than one millimeter to several millimeters, depending on the design constraints and cooling requirements. The impingement apertures 228 may be arranged in rows, staggered patterns, or as a non-uniform array to address non-uniform thermal loading present in the combustor environment.

Further, the combustor assembly 80 of FIG. 9 shows that the liner tiles 120 and retainer assemblies 150 are located so as not to obstruct the flow of cooling fluid from the support shell panel 220 toward the liner tile 120. In some embodiments, features may be added to the support shell panel 220, such as baffles or guides, to direct cooling fluid away from the retainer assemblies 150 or to areas of highest thermal loading.

It is also possible, in further exemplary embodiments, for the support shell panel 220 to comprise a solid support shell panel (e.g., without the impingement apertures 228) or for some portions to be solid and others to include the impingement apertures 228, based on localized requirements. For instance, a region of the support shell panel 220 corresponding to a retainer assembly 150 may lack impingement apertures 228, while other regions have a full grid pattern of the impingement apertures 228. This arrangement may reduce unwanted cooling of certain hardware elements while preserving the liner tile 120 thermal protection.

For instance, in a further embodiment, support shell panels 220 of variable thickness or material may be employed to alter local heat conduction properties or to provide additional durability in high-stress regions. The impingement apertures 228 may additionally be formed as oblique or angled holes to influence the direction of impinging jets and promote secondary fluid motion along the surface of the liner tile 120, thereby increasing local heat transfer rates.

In yet another alternative, more than one support shell panel 220 may be associated with a given liner tile 120, such as a multi-segmented or overlapped configuration for stepped or beveled tiles. Impingement aperture patterns 228 may overlap from adjacent support shell panels 220 to promote uniformity of cooling fluid coverage across tile-to-tile interfaces.

It should be appreciated that all features described in relation to FIG. 9, including the number, arrangement, and configuration of the support shell panels 220, combustor liner support apertures 136, and impingement apertures 228, are optional and may be omitted, varied, or further refined depending on specific application requirements. In summary, FIG. 9 provides detailed illustration and description of an embodiment in which the combustor liner support shell 130 further includes at least one support shell panel 220 separated from the liner tile 120, the support shell panel 220 defining impingement apertures 228 to direct cooling fluid flow for enhanced thermal management.

Figure 10:
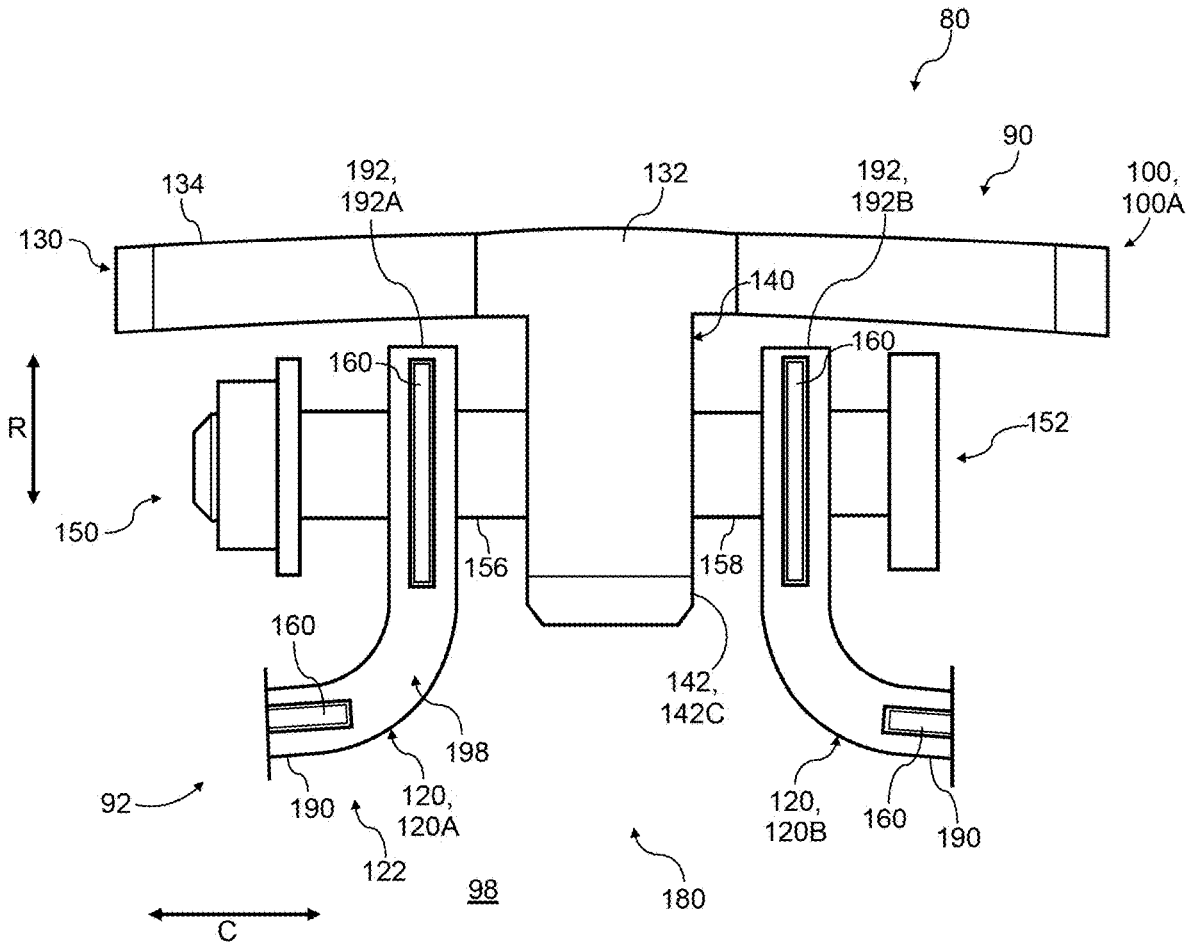
FIG. 10 is a schematic view of a portion of an exemplary combustor assembly in accordance with embodiments of the present disclosure.

FIG. 10 depicts a schematic view of the retainer assembly 150 for floatably coupling the liner tiles 120 to the combustor liner support assembly 100A in accordance with an exemplary aspect of the present disclosure. The exemplary combustor assembly 80 of FIG. 10 may be configured in substantially the same manner as the exemplary assemblies of FIGS. 1-9, and accordingly, the same or similar reference numerals may refer to the same or similar parts. For example, the combustor assembly 80 of FIG. 10 generally includes the combustor liner 90, defined as the outer combustor liner 92, including the liner tiles 120A, 120B, the combustor liner support shell 130, the axial combustor liner support member 132, and the circumferential combustor liner support member 134. However, for the embodiment of FIG. 10, the combustor liner support assembly 100A further defines the rail 140 being T-shaped having a rail leg 142C that extends in the radial direction R toward the combustion chamber 98 (FIG. 3). The adjacent liner tiles 120A and 120B include the respective radial flanges 192A,192B each extending from the corresponding liner tile panel 190 in a direction away from the combustion chamber 98 (FIG. 3) and toward the combustor liner support shell 130. The radial flanges 192A, 192B of the liner tiles 120A, 120B are floatably coupled to the rail leg 142C by respective bushings 156, 158 located on opposite sides of the rail leg 142C, permitting limited movement in the radial R, axial A (in-and-out of the page of FIG. 10), and circumferential C directions.

In the embodiment illustrated in FIG. 10, the liner tiles 120A and 120B, each forming a portion of the outer combustor liner 92, include the respective liner tile panels 190 that are bounded at the edge by the respective radial flanges 192A, 192B. The radial flanges 192A, 192B extend away from the hot face of the liner tile panel 190 (e.g., corresponding to the liner tile inner surface 122 of the respective liner tile 120A, 120B) and define an interface with the combustor liner support assembly 100A. The combustor liner support shell 130 and associated circumferential combustor liner support member 134 and axial combustor liner support member 132 are arranged to provide structural support in the circumferential C and axial A directions, respectively.

The rail 140 includes the rail leg 142C oriented generally in the radial direction R toward the combustion chamber 98 (FIGS. 3 and 4), with each rail leg 142C positioned between the radial flanges 192A and 192B of adjacent liner tiles 120A, 120B. In the illustrated example of FIG. 10, the retainer assembly 150 includes the fastener element 152 extending through the rail leg 142C. The bushings 156, 158 are mounted on the fastener element 152 on opposite sides of the rail leg 142C. The radial flange 192A of liner tile 120A is floatably coupled to the bushing 156 on a first side of the rail leg 142C. The radial flange 192B of the adjacent liner tile 120B is floatably coupled to the bushing 158 on a second, opposite side of the rail leg 142C.

This floatable coupling, using the bushings 156, 158 retained by the fastener element 152 through the rail leg 142C, enables limited movement of the radial flanges 192A, 192B of the respective liner tiles 120A, 120B with respect to the combustor liner support assembly 100A. In the embodiment depicted in FIG. 10, this arrangement permits relative movement in the radial direction R, the axial direction A (in-and-out of the page in FIG. 10), and the circumferential direction C. For example, as each liner tile 120A, 120B experiences thermal expansion or contraction during engine operation, the floatable mounting may improve the likelihood of preventing the development of excessive mechanical stress in the liner tiles 120 or in the combustor liner support assembly 100A.

The configuration of the rail 140, with a rail leg 142C extending radially, is not required in all embodiments; however, in the illustrated version of FIG. 10, the rail 140 facilitates discrete, side-by-side floatable mounting of the radial flanges 192A, 192B by providing opposing surfaces for the bushings 156, 158 and offering a compact fastener location for assembly. Other rail configurations may be used in alternative embodiments.

As described above in connection with at least FIG. 5, between the adjacent liner tiles 120A, 120B, the combustor liner channel 180 extends generally in the axial direction A (in-and-out of the page in FIG. 10). This combustor liner channel 180 is bounded by the liner tile panels 120A, 120B. As described above in connection with at least FIGS. 4 and 5, the fuel cups 86 (FIG. 4) may be located to misalign or be offset with respect to the combustor liner channel 180 such that the retainer assembly 150 is located offset from higher combustion temperatures.

The bushings 156, 158, as shown in FIG. 10, may optionally be constructed from thermally stable or compliant materials allowing limited float and rotational adjustment of the liner tiles 120A, 120B relative to the rail 140 and the combustor liner support shell 130. For example, the bushings 156, 158 may include metallic, ceramic, or coated surfaces to accommodate thermal cycling without excessive wear. Sizes, clearances, and hardness may be selected to achieve the desired degree of float for the specific combustor design.

In the embodiment of FIG. 10, the arrangement of the rail 142C, the bushings 156, 158, and the fastener element 152 provides a method for mounting adjacent liner tiles 120A, 120B so that each liner tile 120A, 120B is capable of independent movement during temperature variation or other loading conditions. For example, in a scenario where the combustor experiences rapid temperature increases during engine start-up, the liner tiles 120A, 120B may expand at different rates or by differing amounts with respect to each other or the combustor liner support shell 130, and the floatable mounting configuration described may accommodate such growth.

While the illustrated embodiment shows a single fastener element 152 and two bushings 156, 158 for two adjacent liner tiles 120A, 120B, in alternative embodiments, additional bushings, anti-rotation elements, or locking features may be provided to further manage relative motion, assembly sequence, or specific operational requirements. The number and spacing of such rails 140 may be varied around the circumference or along the length of the combustor liner support assembly 101A. For instance, in a further example, a greater number of rails 140 may be included in regions subjected to higher mechanical loading, or larger bushings may be used in select locations to permit greater differential movement.

In the embodiment of the combustor assembly 80 depicted in FIGS. 4-10, the rails 140, radial flanges 192 of the liner tiles 120, and the combustor liner channel 180 extend generally in the axial direction A to be axially aligned with a flow of the combustion gases through the combustor 84. However, it should be understood that that embodiments of the combustor assembly 80 may be alternately configured such as, by way of non-limiting example, having the rails 140, radial flanges 192 of the liner tiles 120, and the combustor liner channel 180 extending in the circumferential direction C. In such an exemplary embodiment, the retainer assemblies 150 may extend in the axial direction A instead of in the circumferential direction C as depicted in FIGS. 5 and 10.

Thus, embodiments of the present disclosure provide a combustor assembly for a gas turbine engine including a plurality of liner tiles defining at least a portion of a combustor liner of a combustor of a gas turbine engine. The liner tiles may be metallic or non-metallic. Embodiments of the present disclosure floatably couple the liner tiles to a combustor liner support assembly to enable thermal expansion of the liner tiles in one or more of an axial direction, a radial direction, or a circumferential direction. Further, a retainer assembly according to exemplary embodiments of the present disclosure used to floatably couple the liner tiles to the combustor liner support assembly is substantially shielded from the hot gases within the combustion chamber. The combustor liner support assembly is also configured to provide cooling to the liner tiles. In exemplary embodiments, the combustor liner support assembly includes a number of combustor liner support apertures to enable a cooling fluid supply to impinge directly on the liner tiles. Additionally, embodiments of the present disclosure provide a number of spline seals located with respect to the liner tiles that vary an amount of cooling fluid flow to the liner tiles in response to varying expansion and contraction of the liner tiles due to thermal conditions in the combustor.

Although specific features of various embodiments may be shown in some drawings and not in others, this is for convenience only. In accordance with the principles of the present disclosure, any feature of a drawing may be referenced and/or claimed in combination with any feature of any other drawing.

Further aspects of the disclosure are provided by the subject matter of the following clauses:

A combustor assembly for a gas turbine engine, the combustor assembly comprising: a plurality of liner tiles defining at least part of a combustion chamber, the combustion chamber extending between a forward end and an aft end generally along an axial direction; a combustor liner support assembly positioned on a cold side of the plurality of liner tiles, the combustor liner support assembly defining a rail extending radially toward the combustion chamber; and a retainer assembly comprising a bushing, and wherein at least one liner tile of the plurality of liner tiles is floatably coupled to the rail via the bushing.

The combustor assembly of the preceding clause, wherein the plurality of liner tiles each include a liner tile inner surface facing the combustion chamber and a liner tile outer surface facing away from the combustion chamber, and wherein the rail extends radially toward the liner tile outer surface.

The combustor assembly of any preceding clause, wherein the retainer assembly comprises: a fastener element coupled to the rail; and the bushing mounted on the fastener element.

The combustor assembly of any preceding clause, further comprising one or more spline seals positioned between adjacent ones of the plurality of liner tiles.

The combustor assembly of any preceding clause, wherein at least one spline seal of the one or more spline seals comprises one or more spline seal cooling apertures.

The combustor assembly of any preceding clause, wherein the plurality of liner tiles comprise a first liner tile and a second liner tile, and further comprising at least one spline seal extending from the first liner tile to the second liner tile.

The combustor assembly of any preceding clause, wherein the at least one spline seal comprises at least one spline seal cooling aperture, and wherein the at least one spline seal cooling aperture is arranged to be at least partially obscured at a first temperature in the combustion chamber, and in response to a second temperature in the combustion chamber greater than the first temperature, the at least one spline seal cooling aperture is less obscured than at the first temperature.

The combustor assembly of any preceding clause, wherein the at least one liner tile comprises: a liner tile panel; and a radial flange extending from the liner tile panel; and wherein the radial flange is floatably coupled to the bushing.

The combustor assembly of any preceding clause, wherein the gas turbine engine further defines a circumferential direction, and wherein the combustor liner support assembly comprises: a combustor liner support shell defining a plurality of circumferentially-spaced axial combustor liner support members and a plurality of axially-spaced circumferential combustor liner support members.

The combustor assembly of any preceding clause, wherein the combustor liner support shell comprises at least one combustor liner support aperture defined by a pair of the plurality of axial combustor liner support members and a pair of the circumferential combustor liner support members.

The combustor assembly of any preceding clause, wherein the rail extends from at least one of the axial combustor liner support members.

The combustor assembly of any preceding clause, further comprising: a plurality of circumferentially-spaced fuel cups located at the forward end; and wherein each fuel cup of the plurality of fuel cups is circumferentially offset with respect to the rail.

The combustor assembly of any preceding clause, wherein the gas turbine engine further defines a circumferential direction, and wherein the combustor liner support assembly comprises: a combustor liner support shell defining a plurality of circumferentially-spaced axial combustor liner support members and a plurality of axially-spaced circumferential combustor liner support members; and at least one support shell panel coupled to respective ones of the plurality of circumferentially-spaced axial combustor liner support members and respective ones of the plurality of axially-spaced circumferential combustor liner support members, the at least one support shell panel spaced radially apart from the at least one liner tile.

The combustor assembly of any preceding clause, wherein the at least one support shell panel is a solid support shell panel.

The combustor assembly of any preceding clause, wherein the at least one support shell panel comprises one or more impingement apertures to provide impingement cooling to the at least one liner tile.

The combustor assembly of any preceding clause, wherein the plurality of liner tiles each include a liner tile inner surface facing the combustion chamber and a liner tile outer surface facing away from the combustion chamber, and wherein the combustor liner support assembly defines a plurality of combustor liner support apertures in fluid communication with the liner tile outer surface of respective ones of the plurality of liner tiles.

The combustor assembly of any preceding clause, wherein the rail is a U-shaped rail.

The combustor assembly of any preceding clause, wherein the rail comprises a first rail leg spaced apart from a second rail leg, the first and second rail legs extending radially toward the combustion chamber.

The combustor assembly of any preceding clause, wherein the rail comprises a first rail leg spaced apart from a second rail leg, the first and second rail legs extending radially toward the combustion chamber.

The combustor assembly of any previous clause, wherein the retainer assembly comprises: a fastener element extending through the first and second rail legs; and the bushing mounted on the fastener element between the first and second rail legs.

The combustor assembly of any preceding clause, wherein the retainer assembly comprises: a fastener element extending through the first and second rail legs; and the bushing mounted on the fastener element between the first and second rail legs.

The combustor assembly of any preceding clause, wherein the rail is a T-shaped rail.

The combustor assembly of any preceding clause, wherein the rail is a U-shaped rail or a T-shaped rail.

The combustor assembly of any preceding clause, wherein the rail comprises a rail leg extending radially toward the combustion chamber.

The combustor assembly of any preceding clause, wherein the bushing includes a first bushing and a second bushing, and wherein the retainer assembly comprises: a fastener element extending through the rail leg; the first bushing mounted on the fastener element on a first side of the rail leg; and the second bushing mounted on the fastener element on a second side of the rail leg opposite the first side.

The combustor assembly of any preceding clause, wherein the plurality of liner tiles define an outer combustor liner or an inner combustor liner.

A combustor assembly for a gas turbine engine, the gas turbine engine defining an axial direction, the combustor assembly comprising: a combustor liner support assembly; a plurality of liner tiles defining at least part of a combustion chamber, the combustion chamber extending between a forward end and an aft end generally along the axial direction with respect to the combustor liner support assembly; and one or more spline seals arranged between adjacent liner tiles of the plurality of liner tiles, and wherein at least one spline seal of the one or more spline seals comprises a spline seal cooling aperture, and wherein the at least one spline seal cooling aperture is arranged to be at least partially obscured at a first temperature in the combustion chamber, and in response to a second temperature in the combustion chamber greater than the first temperature, the at least one spline seal cooling aperture is less obscured than at the first temperature.

The combustor assembly of any preceding clause, wherein the adjacent liner tiles define a first spacing therebetween at the first temperature and a second spacing therebetween at the second temperature, wherein the second spacing is greater than the first spacing, and wherein the second spacing exposes a greater portion of the spline seal cooling aperture than the first spacing.

A combustor assembly for a gas turbine engine, the gas turbine engine defining an axial direction and a radial direction, the combustor assembly comprising: a combustor liner support assembly; and a plurality of liner tiles defining at least part of a combustion chamber, the combustion chamber extending between a forward end and an aft end generally along the axial direction with respect to the combustor liner support assembly, wherein at least one liner tile of the plurality of liner tiles comprises: a liner tile panel, a first radial flange, and a second radial flange on an opposite end of the liner tile panel than the first radial flange; a first spline seal extending from the first radial flange to an adjacent liner tile of the plurality of liner tiles; a second spline seal extending from the liner tile panel to the adjacent liner tile; and a third spline seal extending from the second radial flange to the adjacent liner tile.

The combustor assembly of any preceding clause, wherein the first and second spline seals define a spline seal gap therebetween.

The combustor assembly of any preceding clause, wherein the second spline seal includes a plurality of spline seals extending from the liner tile panel to the adjacent liner tile.

The combustor assembly of any preceding clause, wherein at least one of the first, second, or third spline seals comprises a spline seal cooling aperture.

A combustor assembly for a gas turbine engine, the gas turbine engine defining an axial direction, the combustor assembly comprising: a combustor liner support assembly; and a plurality of liner tiles defining at least part of a combustion chamber, the combustion chamber extending between a forward end and an aft end generally along the axial direction with respect to the combustor liner support assembly, wherein at least two adjacent liner tiles of the plurality of liner tiles comprise a radial flange coupled to the combustor liner support assembly; and a plurality of circumferentially-spaced fuel cups located at the forward end, wherein the fuel cups are in a clocked position that is circumferentially misaligned with respect to the respective radial flanges of the adjacent liner tiles.

A gas turbine engine defining an axial direction, the gas turbine engine comprising: a fan section comprising a fan; and a turbomachine drivably coupled to the fan, the turbomachine comprising a compressor section, a combustion section, and a turbine section in serial flow order, the combustion section comprising: a plurality of liner tiles defining at least part of a combustion chamber, the combustion chamber extending between a forward end and an aft end generally along the axial direction; a combustor liner support assembly positioned on a cold side of the plurality of liner tiles, the combustor liner support assembly defining a rail extending radially toward the combustion chamber; and a retainer assembly comprising a bushing, and wherein at least one liner tile of the plurality of liner tiles is floatably coupled to the rail via the bushing.

A combustor assembly for a gas turbine engine, the gas turbine engine defining an axial direction, the combustor assembly comprising: a combustor liner support assembly; a plurality of liner tiles defining at least part of a combustion chamber, the combustion chamber extending between a forward end and an aft end generally along the axial direction with respect to the combustor liner support assembly, wherein the plurality of liner tiles comprise a first liner tile and a second liner tile adjacent the first liner tile, wherein a first liner tile spacing is defined between the first and second liner tiles at a first temperature of the combustion chamber, and a second liner tile spacing greater than the first liner tile spacing is defined between the first and second liner tiles at a second temperature of the combustion chamber greater than the first temperature; and a spline seal positioned between the first and second liner tiles, wherein the spline seal defines a spline seal cooling aperture, the spline seal cooling aperture positioned to provide a greater cooling airflow through the spline seal cooling aperture at the second liner tile spacing than the first liner tile spacing.

The combustor assembly of any preceding clause, wherein the combustor liner support assembly comprises: a rail extending radially toward the combustion chamber; a fastener element coupling a bushing to the rail; and wherein at least one of the first liner tile or the second liner tile is floatably coupled to the bushing.

A combustor assembly for a gas turbine engine, the gas turbine engine defining an axial direction, the combustor assembly comprising: a combustor liner support assembly; and a plurality of liner tiles defining at least part of a combustion chamber, the combustion chamber extending between a forward end and an aft end generally along the axial direction with respect to the combustor liner support assembly, wherein the plurality of liner tiles comprise: a first liner tile including a first radial flange; and a second liner tile positioned adjacent the first liner tile, the second liner tile including a second radial flange positioned adjacent the first radial flange, the first radial flange and the second radial flange defining a combustor liner channel therebetween; and a fuel cup located at the forward end, wherein the fuel cup is in a clocked position that is circumferentially misaligned with respect to the combustor liner channel.

The combustor assembly of any preceding clause, wherein the combustor liner channel extends in the axial direction.

The combustor assembly of any preceding clause, wherein at least one liner tile of the plurality of liner tiles defines a spline seal channel, and wherein at least one spline seal of the one or more spline seals fits within the spline seal channel.

The combustor assembly of any preceding clause, wherein the plurality of liner tiles define an outer combustor liner, and wherein the combustor liner support assembly is positioned radially outward from the outer combustor liner.

The combustor assembly of any preceding clause, wherein the gas turbine engine defines a circumferential direction, and wherein plurality of liner tiles comprise: a first plurality of liner tiles extending in the axial direction; and a second plurality of liner tiles extending in the circumferential direction.

The combustor assembly of any preceding clause, wherein the gas turbine engine defines a circumferential direction, and wherein plurality of liner tiles extend circumferentially to define an annular combustor liner This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a gas turbine engine, the combustor assembly comprising:

a plurality of liner tiles defining at least part of a combustion chamber, the combustion chamber extending between a forward end and an aft end generally along an axial direction;

a combustor liner support assembly positioned on a cold side of the plurality of liner tiles, the combustor liner support assembly defining a rail extending radially toward the combustion chamber; and a retainer assembly comprising a bushing, the bushing extending through at least a portion of at least one liner tile of the plurality of liner tiles, wherein the at least one liner tile is floatably coupled to the rail via the bushing.

2. The combustor assembly of claim 1, wherein the plurality of liner tiles each include a liner tile inner surface facing the combustion chamber and a liner tile outer surface facing away from the combustion chamber, and wherein the rail extends radially toward the liner tile outer surface.

3. The combustor assembly of claim 1, wherein the retainer assembly comprises:

a fastener element coupled to the rail; and the bushing mounted on the fastener element.

4. The combustor assembly of claim 1, further comprising one or more spline seals positioned between adjacent ones of the plurality of liner tiles.

5. The combustor assembly of claim 4, wherein at least one spline seal of the one or more spline seals comprises one or more spline seal cooling apertures.

6. The combustor assembly of claim 1, wherein the plurality of liner tiles comprise a first liner tile and a second liner tile, and further comprising at least one spline seal extending from the first liner tile to the second liner tile.

7. The combustor assembly of claim 6, wherein the at least one spline seal comprises at least one spline seal cooling aperture, and wherein the at least one spline seal cooling aperture is arranged to be at least partially obscured at a first temperature in the combustion chamber, and in response to a second temperature in the combustion chamber greater than the first temperature, the at least one spline seal cooling aperture is less obscured than at the first temperature.

8. The combustor assembly of claim 1, wherein the at least one liner tile comprises:

a liner tile panel; and a radial flange extending from the liner tile panel; and wherein the radial flange is floatably coupled to the bushing.

9. The combustor assembly of claim 1, wherein the gas turbine engine further defines a circumferential direction, and wherein the combustor liner support assembly comprises:

a combustor liner support shell defining a plurality of circumferentially-spaced axial combustor liner support members and a plurality of axially-spaced circumferential combustor liner support members.

10. The combustor assembly of claim 9, wherein the combustor liner support shell comprises at least one combustor liner support aperture defined by a pair of the plurality of axial combustor liner support members and a pair of the plurality of circumferential combustor liner support members.

11. The combustor assembly of claim 9, wherein the rail extends from at least one axial combustor liner support member of the plurality of axial combustor liner support members.

12. The combustor assembly of claim 1, further comprising:

a plurality of circumferentially-spaced fuel cups located at the forward end; and wherein each fuel cup of the plurality of fuel cups is circumferentially offset with respect to a circumferential location of the rail.

13. The combustor assembly of claim 1, wherein the gas turbine engine further defines a circumferential direction, and wherein the combustor liner support assembly comprises:

a combustor liner support shell defining a plurality of circumferentially-spaced axial combustor liner support members and a plurality of axially-spaced circumferential combustor liner support members; and at least one support shell panel coupled to respective ones of the plurality of circumferentially-spaced axial combustor liner support members and respective ones of the plurality of axially-spaced circumferential combustor liner support members, the at least one support shell panel spaced radially apart from the at least one liner tile.

14. The combustor assembly of claim 13, wherein the at least one support shell panel comprises one or more impingement apertures to provide impingement cooling to the at least one liner tile.

15. The combustor assembly of claim 1, wherein the rail is a U-shaped rail or a T-shaped rail.

16. The combustor assembly of claim 1, wherein the rail comprises a first rail leg spaced apart from a second rail leg, the first and second rail legs extending radially toward the combustion chamber.

17. The combustor assembly of claim 16, wherein the retainer assembly comprises:

a fastener element extending through the first and second rail legs; and the bushing mounted on the fastener element between the first and second rail legs.

18. A gas turbine engine defining an axial direction, the gas turbine engine comprising:

a fan section comprising a fan; and a turbomachine drivably coupled to the fan, the turbomachine comprising a compressor section, a combustion section, and a turbine section in serial flow order, the combustion section comprising:

a plurality of liner tiles defining at least part of a combustion chamber, the combustion chamber extending between a forward end and an aft end generally along the axial direction;

a combustor liner support assembly positioned on a cold side of the plurality of liner tiles, the combustor liner support assembly defining a rail extending radially toward the combustion chamber; and a retainer assembly comprising a bushing, the bushing extending through at least a portion of at least one liner tile of the plurality of liner tiles, wherein the at least one liner tile is floatably coupled to the rail via the bushing.

19. A combustor assembly for a gas turbine engine, the gas turbine engine defining an axial direction, the combustor assembly comprising:

a combustor liner support assembly;

a plurality of liner tiles defining at least part of a combustion chamber, the combustion chamber extending between a forward end and an aft end generally along the axial direction with respect to the combustor liner support assembly, wherein the plurality of liner tiles comprise a first liner tile and a second liner tile adjacent the first liner tile, wherein a first liner tile spacing is defined between the first and second liner tiles at a first temperature of the combustion chamber, and a second liner tile spacing greater than the first liner tile spacing is defined between the first and second liner tiles at a second temperature of the combustion chamber greater than the first temperature;

a spline seal positioned between the first and second liner tiles, wherein the spline seal defines a spline seal cooling aperture, the spline seal cooling aperture positioned to provide a greater cooling airflow through the spline seal cooling aperture at the second liner tile spacing than the first liner tile spacing;

a rail extending radially toward the combustion chamber; and a fastener element coupling a bushing to the rail, wherein at least one of the first liner tile or the second liner tile is floatably coupled to the bushing, and wherein the bushing extends through at least a portion of the at least one of the first liner tile or the second liner tile.

* * * * *